US009691372B2

(12) United States Patent
Matsumoto

(10) Patent No.: US 9,691,372 B2
(45) Date of Patent: Jun. 27, 2017

(54) NOISE SUPPRESSION DEVICE, NOISE SUPPRESSION METHOD, AND NON-TRANSITORY COMPUTER-READABLE RECORDING MEDIUM STORING PROGRAM FOR NOISE SUPPRESSION

(71) Applicant: FUJITSU LIMITED, Kawasaki-shi, Kanagawa (JP)

(72) Inventor: Chikako Matsumoto, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 15/066,240

(22) Filed: Mar. 10, 2016

(65) Prior Publication Data

US 2016/0284336 A1 Sep. 29, 2016

(30) Foreign Application Priority Data

Mar. 24, 2015 (JP) ..... 2015-060628

(51) Int. Cl.
*G10K 11/178* (2006.01)
*G10L 21/0216* (2013.01)
(Continued)

(52) U.S. Cl.
CPC ..... *G10K 11/1784* (2013.01); *G10L 21/0208* (2013.01); *G10L 21/0216* (2013.01);
(Continued)

(58) Field of Classification Search
CPC ..... G10K 11/16; G10L 21/0208
(Continued)

(56) References Cited

U.S. PATENT DOCUMENTS

2006/0215854 A1 9/2006 Suzuki et al.
2007/0223714 A1* 9/2007 Nishikawa ..... G10K 11/1788 381/71.1
(Continued)

FOREIGN PATENT DOCUMENTS

EP 2 755 204 A1 7/2014
JP 2006-267444 10/2006
(Continued)

OTHER PUBLICATIONS

Shimoyama et al., "Multiple acoustic source localization using ambiguous phase differences under reverberative conditions", Acoustical Science and Technology, vol. 25, No. 6, Acoustical Society of Japan, Nov. 2004, pp. 446-456.
(Continued)

*Primary Examiner* — Mohammad Islam
(74) *Attorney, Agent, or Firm* — Staas & Halsey LLP

(57) ABSTRACT

A noise suppression device includes a generator to generate, on basis of phase differences between phases of the signals input from microphones, additional data obtained by rotating the phase differences; an estimator to select one or multiple ranges in association with a direction in which a sound source of a target sound included in the input signals exists at a high probability, and to estimate, on basis of the phase differences and the additional data, a range that is among the selected one or multiple ranges and in which the sound source exists; and an output signal generator configured to generate, on basis of a suppression coefficient set on basis of a result of determination of whether or not the sound source exists in the estimated range, a output signal in which the noise in the input signals is suppressed.

15 Claims, 21 Drawing Sheets

(51) Int. Cl.
*H04R 3/00* (2006.01)
*G10L 21/0208* (2013.01)

(52) U.S. Cl.
CPC ..... *H04R 3/005* (2013.01); *G10K 2210/3025* (2013.01); *G10K 2210/3044* (2013.01); *G10K 2210/30231* (2013.01); *G10L 2021/02166* (2013.01)

(58) Field of Classification Search
USPC ..... 381/71.12, 92, 94.1–94.3
See application file for complete search history.

(56) References Cited

U.S. PATENT DOCUMENTS

2009/0196434 A1 8/2009 Sugiyama et al.
2010/0111325 A1* 5/2010 Matsuo ..... H04R 3/005 381/92
2011/0158426 A1* 6/2011 Matsuo ..... H04R 3/005 381/92
2012/0134509 A1* 5/2012 Matsumoto ..... G10L 21/0208 381/94.3
2013/0166286 A1* 6/2013 Matsumoto ..... G10L 21/02 704/205
2014/0098968 A1* 4/2014 Furuta ..... G10K 11/16 381/71.12
2014/0200886 A1* 7/2014 Matsumoto ..... G10L 21/0208 704/226
2014/0241546 A1* 8/2014 Matsumoto ..... H04R 3/04 381/86
2015/0088494 A1* 3/2015 Matsumoto ..... G10L 21/0232 704/205

FOREIGN PATENT DOCUMENTS

JP 2012-49715 3/2012
JP 2013-142797 7/2013
JP 2014-137414 7/2014
WO WO 2007/029536 A1 3/2007

OTHER PUBLICATIONS

Extended European Search Report dated Aug. 3, 2016 in corresponding European Patent Application No. 16159827.1.

* cited by examiner

FIG. 6

| | INCLINATION $\alpha 1$ OF LOWER LIMIT BOUNDARY | INCLINATION $\alpha 2$ OF UPPER LIMIT BOUNDARY |
|---|---|---|
| RANGE 1 | 0.03 | 0.05 |
| RANGE 2 | 0.02 | 0.04 |
| RANGE 3 | 0.01 | 0.03 |
| RANGE 4 | 0.00 | 0.02 |
| RANGE 5 | -0.01 | 0.01 |
| RANGE 6 | -0.02 | 0.00 |
| RANGE 7 | -0.03 | -0.01 |
| RANGE 8 | -0.04 | -0.02 |
| RANGE 9 | -0.05 | -0.03 |

FIG. 8

| | INCLINATION $\alpha$ | Y INTERCEPT $\beta$ |
|---|---|---|
| BL1 | 0.05 | 0.5 |
| BL2 | 0.04 | 0.4 |
| BL3 | 0.03 | 0.3 |
| BL4 | 0.02 | 0.2 |
| BL5 | 0.01 | 0.1 |
| BL6 | 0.00 | 0.0 |
| BL7 | -0.01 | -0.1 |
| BL8 | -0.02 | -0.2 |
| BL9 | -0.03 | -0.3 |
| BL10 | -0.04 | -0.4 |
| BL11 | -0.05 | -0.5 |

◆(BLACK DIAMOND SHAPE): CALCULATED PHASE DIFFERENCE AT CERTAIN TIME
△(UPWARD TRIANGLE): PHASE OF CORRESPONDING BLACK DIAMOND SHAPE+2 π
▽(DOWNWARD TRIANGLE): PHASE OF CORRESPONDING BLACK DIAMOND SHAPE−2 π

◆(BLACK DIAMOND SHAPE): CALCULATED PHASE DIFFERENCE AT CERTAIN TIME
△(UPWARD TRIANGLE): PHASE OF CORRESPONDING BLACK DIAMOND SHAPE+2 π
▽(DOWNWARD TRIANGLE): PHASE OF CORRESPONDING BLACK DIAMOND SHAPE−2 π

◆(BLACK DIAMOND SHAPE): CALCULATED PHASE DIFFERENCE AT CERTAIN TIME
△(UPWARD TRIANGLE): PHASE OF CORRESPONDING BLACK DIAMOND SHAPE+2 π
▽(DOWNWARD TRIANGLE): PHASE OF CORRESPONDING BLACK DIAMOND SHAPE−2 π

◆(BLACK DIAMOND SHAPE): CALCULATED PHASE DIFFERENCE AT CERTAIN TIME
△(UPWARD TRIANGLE): PHASE OF CORRESPONDING BLACK DIAMOND SHAPE+2 π
▽(DOWNWARD TRIANGLE): PHASE OF CORRESPONDING BLACK DIAMOND SHAPE−2 π

FIG. 17A

| | LOW-FREQUENCY RANGE (EQUAL TO AND LOWER THAN Fmax) | MIDDLE- AND HIGH-FREQUENCY RANGE (HIGHER THAN Fmax) |
|---|---|---|
| CONVENTIONAL TECHNIQUE 1 (PHASE DIFFERENCE + AMPLITUDE RATIO) | NOISE IS SUPPRESSED BUT SIGNAL IS DISTORTED | NOISE IS SUPPRESSED BUT SIGNAL IS DISTORTED |
| CONVENTIONAL TECHNIQUE 2 (ONLY PHASE DIFFERENCE) | NOISE IS SUPPRESSED | NOISE IS NOT SUPPRESSED |
| PRESENT METHOD | NOISE IS SUPPRESSED | NOISE IS SUPPRESSED |

FIG. 17B

| | SUPPRESSED STATIONARY NOISE VOLUME (dB) | SUPPRESSED NON-STATIONARY NOISE VOLUME (dB) | SUPPRESSED SOUND VOLUME (dB) |
|---|---|---|---|
| CONVENTIONAL TECHNIQUE 1 (PHASE DIFFERENCE + AMPLITUDE RATIO) | 16.1 | 5.3 | 3.7 |
| CONVENTIONAL TECHNIQUE 2 (ONLY PHASE DIFFERENCE) | 16.1 | 3.1 | 1.5 |
| PRESENT METHOD | 16.2 | 6.7 | 1.7 |

NOISE SUPPRESSION DEVICE, NOISE SUPPRESSION METHOD, AND NON-TRANSITORY COMPUTER-READABLE RECORDING MEDIUM STORING PROGRAM FOR NOISE SUPPRESSION

CROSS-REFERENCE TO RELATED APPLICATION

This application is based upon and claims the benefit of priority of the prior Japanese Patent Application No. 2015-060628, filed on Mar. 24, 2015, the entire contents of which are incorporated herein by reference.

FIELD

The embodiments discussed herein are related to a noise suppression device, a noise suppression method, and a non-transitory computer-readable recording medium storing program for noise suppression.

BACKGROUND

A noise suppression device that suppresses noise after converting input signals in(t) into a frequency domain signal, inversely converts the frequency domain signal into a time domain signal, and outputs the signal out (t) is known.

Such noise suppression devices are installed in devices of many types such as mobile phones. In recent years, devices that include a noise suppression device each include multiple microphones for collecting sounds, and distances between microphones included in each device tend to be larger.

As a conventional noise suppression method, a method (beam forming) using an amplitude ratio is known (refer to, for example, Japanese Laid-open Patent Publication No. 2014-137414). However, when a distance between microphones is large, the sensitivities of the microphones are not equal due to the positions of the installed microphones and vocal tract shapes. When microphones that have sensitivities between which the difference is large are used and noise suppression is executed using an amplitude ratio, a target sound (voice) is largely distorted.

SUMMARY

According to an aspect of the invention, a noise suppression device configured to suppress noise in signals input from a plurality of microphones, the noise suppression device includes a generator configured to generate, on basis of phase differences between phases of the signals input from the plurality of microphones for each frequency, additional data obtained by rotating the phase differences; an estimator configured to select, on basis of the phase differences in a frequency band in which the phase differences are not rotated, one or multiple ranges in association with a direction in which a sound source of a target sound included in the input signals exists at a high probability, the one or multiple ranges being defined on a frequency and phase difference plane, and to estimate, on basis of the phase differences and the additional data, a range that is among the selected one or multiple ranges and in which exists the sound source; and an output signal generator configured to generate, on basis of a suppression coefficient set on basis of a result of determination of whether or not the sound source exists in the estimated range, a output signal in which the noise in the input signals is suppressed.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

FIG. 6 is a diagram describing the third example of the range setting;

FIG. 8 is a diagram describing the fourth example of the range setting;

FIGS. 17A and 17B are diagrams describing effects of the noise suppression process according to the first embodiment;

DESCRIPTION OF EMBODIMENTS

It is desired to provide a noise suppression device, a noise suppression method, a computer-readable recording medium storing program for noise suppression while suppressing distortion of a target sound even in a case in which a distance between microphones is large and a difference between the sensitivities of the microphones is large.

Hereinafter, embodiments are described with reference to the accompanying drawings.

<First Embodiment>

Figure 1:
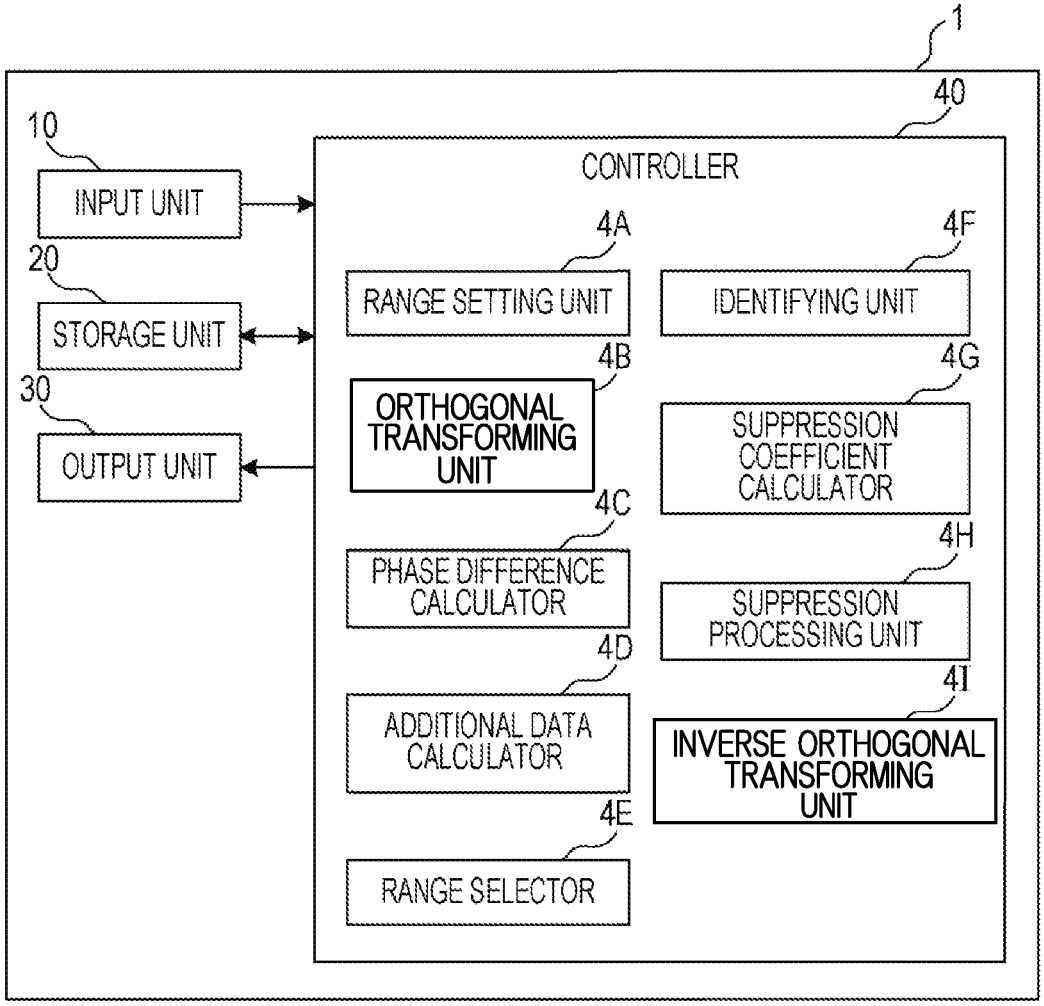
FIG. 1 is a functional block diagram illustrating an example of a configuration of a noise suppression device according to a first embodiment.
Figure 2:
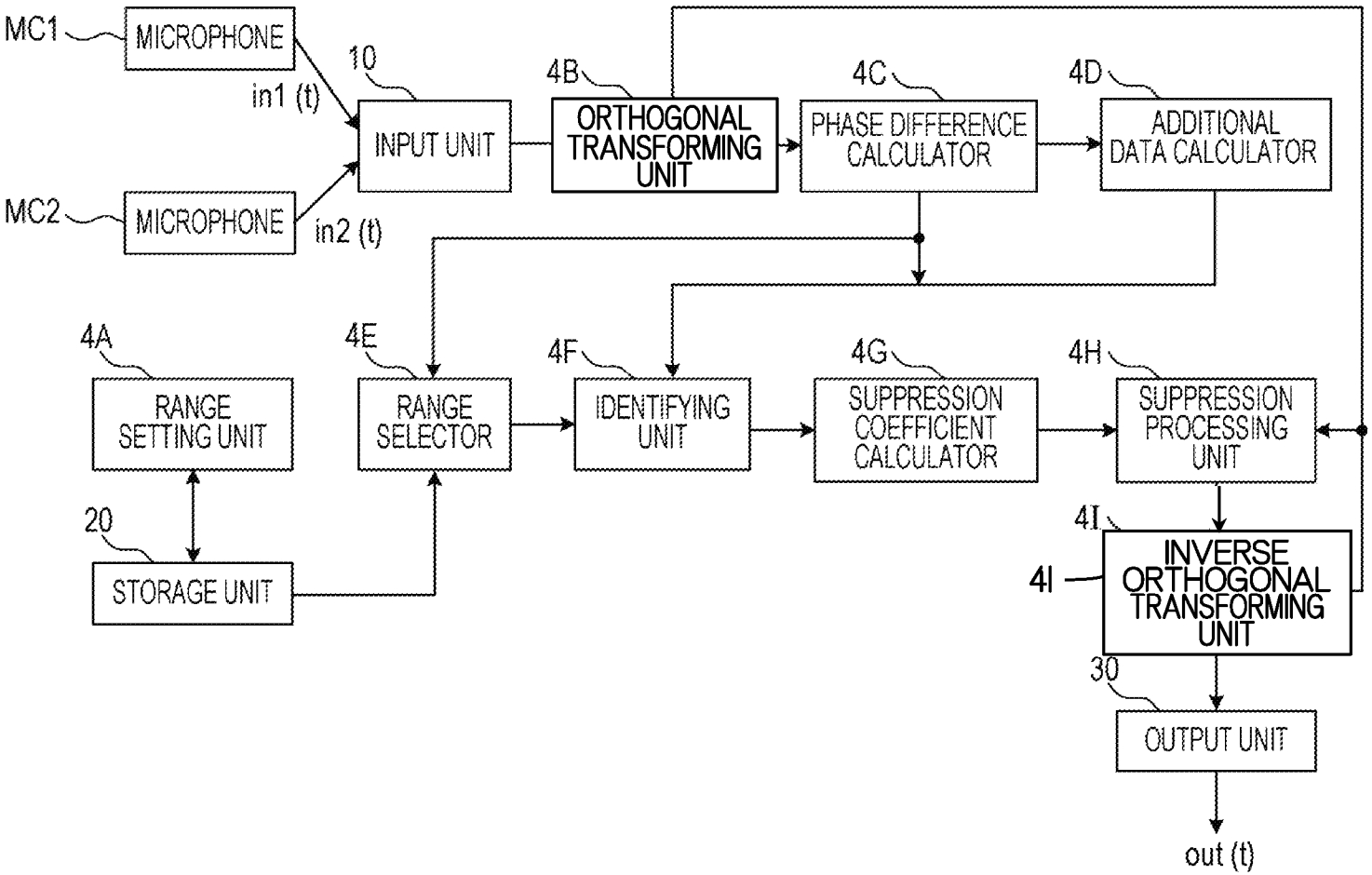
FIG. 2 is a diagram schematically illustrating the flows of signals according to the first embodiment.

FIG. 1 is a functional block diagram illustrating an example of a configuration of a noise suppression device 1 according to the first embodiment. FIG. 2 is a diagram schematically illustrating the flows of signals according to the first embodiment.

The noise suppression device 1 according to the first embodiment converts signals ink(t) (input signals in1(*t*) and in2(*t*) in the example of FIG. 2) input from multiple microphones MCk (microphones MC1 and MC2 in the example of FIG. 2) into a frequency domain signal, suppresses noise after the conversion, inversely converts the frequency domain signal into a time domain signal, and outputs the time domain signal out(t). In this case, k is an integer of "2" or larger. Unless otherwise distinguished, the microphones MCk are collectively referred to as microphones MC and the input signals ink(t) are collectively referred to as input signals in(t). The noise suppression device 1 includes an input unit 10, a storage unit 20, an output unit 30, and a controller 40, as illustrated in FIG. 1.

The input unit 10 includes an audio interface, an audio communication module, or the like, for example. The input unit 10 receives the input signals in(t) to be processed and converts the received input signals in(t) into digital signals at a sampling frequency Fs. Then, the input unit 10 outputs the input signals in(t) converted into the digital signals to an orthogonal transforming unit 4B, as illustrated in FIG. 2. The orthogonal transforming unit 4B is described later in detail.

The storage unit 20 includes a random access memory (RAM), a read only memory (ROM), and the like. The storage unit 20 functions as a work area of a central processing unit (CPU) included in the controller 40 and functions as a program area for storing various programs such as an operation program to be executed to control the overall noise suppression device 1, for example. In addition, the storage unit 20 functions as a data area for storing data of various types such as microphone distance information indicating a distance D between the microphones MC connected to the noise suppression device 1, sampling frequency information indicating the sampling frequency Fs, sound speed information indicating a sound speed C, and frame length information indicating a frame length $L_F$. In the data area, a maximum frequency bin Bmax (described later in detail) calculated by a range setting unit 4A (described later in detail) and range information indicating set phase difference ranges (described later in detail) are stored.

The sound speed information may be information indicating a sound speed C at each temperature or may be information indicating a sound speed C at the temperature of a general environment in which the noise suppression device is used. When the sound speed information indicates a sound speed C at each temperature, a temperature sensor may measure the temperature of the environment in which the noise suppression device is used and the noise suppression device may identify a sound speed C at the measured temperature.

The output unit 30 includes an audio interface, an audio communication module, or the like, for example. The output unit 30 outputs the signal out(t) after noise suppression.

The controller 40 includes the CPU and the like, for example. The controller 40 executes the operation program stored in the program area of the storage unit 20 and thereby achieves functions as the range setting unit 4A, the orthogonal transforming unit 4B, a phase difference calculator 4C, an additional data calculator 4D, a range selector 4E, an identifying unit 4F, a suppression coefficient calculator 4G, a suppression processing unit 4H, and an inverse orthogonal transforming unit 4I, as illustrated in FIG. 1. The controller 40 executes the operation program and thereby executes processes such as a process of controlling the overall noise suppression device 1 and a noise suppression process (described later in detail).

The range setting unit 4A sets a plurality of ranges (hereinafter referred to as phase difference ranges) of phase differences, while the ranges are defined by boundary lines on a frequency bin and phase difference plane. In addition, the range setting unit 4A acquires the sound speed information and microphone distance information stored in the data area of the storage unit 20 and calculates, according to the following Equation 1, a maximum frequency Fmax at which phase rotation does not occur.

$$F_{max}=C/D\times 2 \qquad \text{Equation 1}$$

Then, the range setting unit 4A acquires the frame length information and sampling frequency information stored in the data area of the storage unit 20 and converts the maximum frequency Fmax into the maximum frequency bin Bmax according to the following Equation 2. Specifically, Bmax indicates the maximum frequency Fmax expressed by the frequency bin.

$$B_{max} = F_{max} \times \frac{L_F}{F_s} = \frac{C \times L_F}{2 \times F_s \times D} \qquad \text{Equation 2}$$

Then, the range setting unit 4A causes the range information indicating the set phase difference ranges and the maximum frequency bin Bmax indicating the calculated maximum frequency Fmax expressed by frequency bin to be stored in the data area of the storage unit 20. The range information may be information of the boundary lines BL defining the phase difference ranges, for example.

For example, when the sound speed C is 340 m/s, the distance D between the microphones is 0.1 m, the sampling frequency Fs is 8 kHz, and the frame length $L_F$ is 256, Fmax=340/0.2=1,700 Hz and Bmax=1700×256/8000≅54.4 bins.

Figure 3:
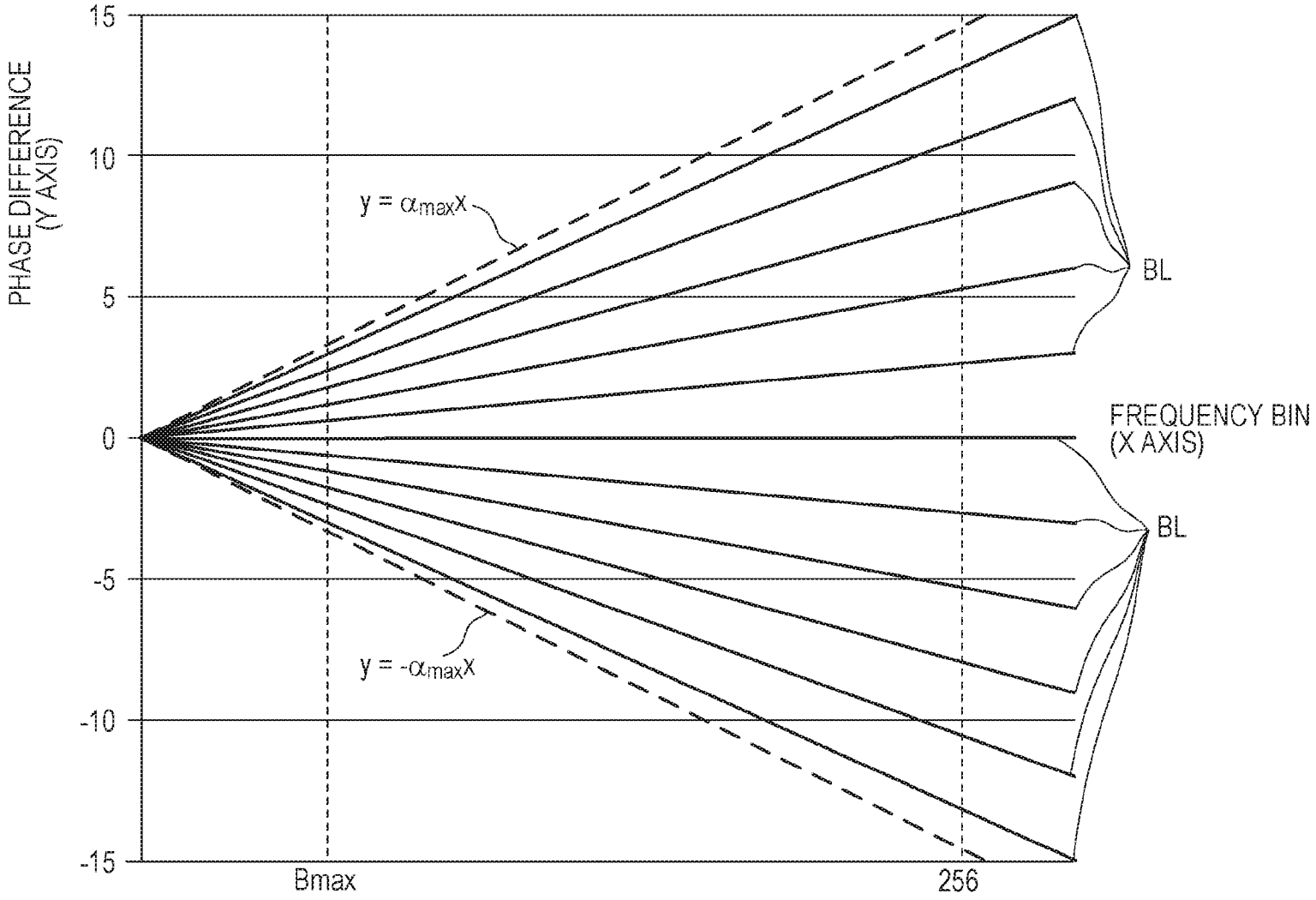
FIG. 3 is a diagram describing a first example of range setting.

Examples of the phase difference ranges set by the range setting unit 4A are described below with reference to FIGS. 3 to 8. FIG. 3 is a diagram describing a first example of the range setting. Referring to FIG. 3, phase difference ranges are defined between pairs of adjacent boundary lines BL, and angles formed by the pairs of boundary lines BL defining the phase difference ranges are set to be equal to each other in the first example. In the first example, a frequency is indicated by X axis, a phase difference is indicated by Y axis, and the range setting unit 4A may define the boundary lines BL by using straight lines expressed by $y=\alpha x$ and thereby set the phase difference ranges. For example, inclinations $\alpha$ of the straight lines expressed by $y=\alpha x$ which indicates the boundary lines BL may be defined as $\alpha=0.01\times a$ (a is integers). In this case, the range setting unit 4A may calculate the maximum value $\alpha_{max}$ among the inclinations $\alpha$ and define the boundary lines BL so as to ensure that absolute values $|\alpha|$ of the inclinations $\alpha$ do not exceed the maximum value $\alpha_{max}$.

The maximum value $\alpha_{max}$ is an inclination of a straight line $y=\alpha x$ which takes "$\pi$" at the maximum frequency bin Bmax corresponding to the maximum frequency Fmax expressed by a frequency bin, in which the maximum frequency Fmax corresponds to the maximum frequency at which phase rotation does not occur. Thus, the range setting unit 4A may calculate the maximum value $\alpha_{max}$ according to the following Equation 3 using the Equation 2.

$$\alpha_{max} = \frac{\pi}{B_{max}} = \frac{2\pi \times F_s \times D}{C \times L_F} \quad \text{Equation 3}$$

For example, when the sound speed C is 340 m/s, the distance D between the microphones is 0.1 m, the sampling frequency Fs is 8 kHz, and the frame length $L_F$ is 256, $\alpha_{max}$=3.14/54.4≈0.058. In this case, the range setting unit 4A uses 11 boundary lines BL to set phase difference ranges, as illustrated in FIG. 3.

Figure 4:
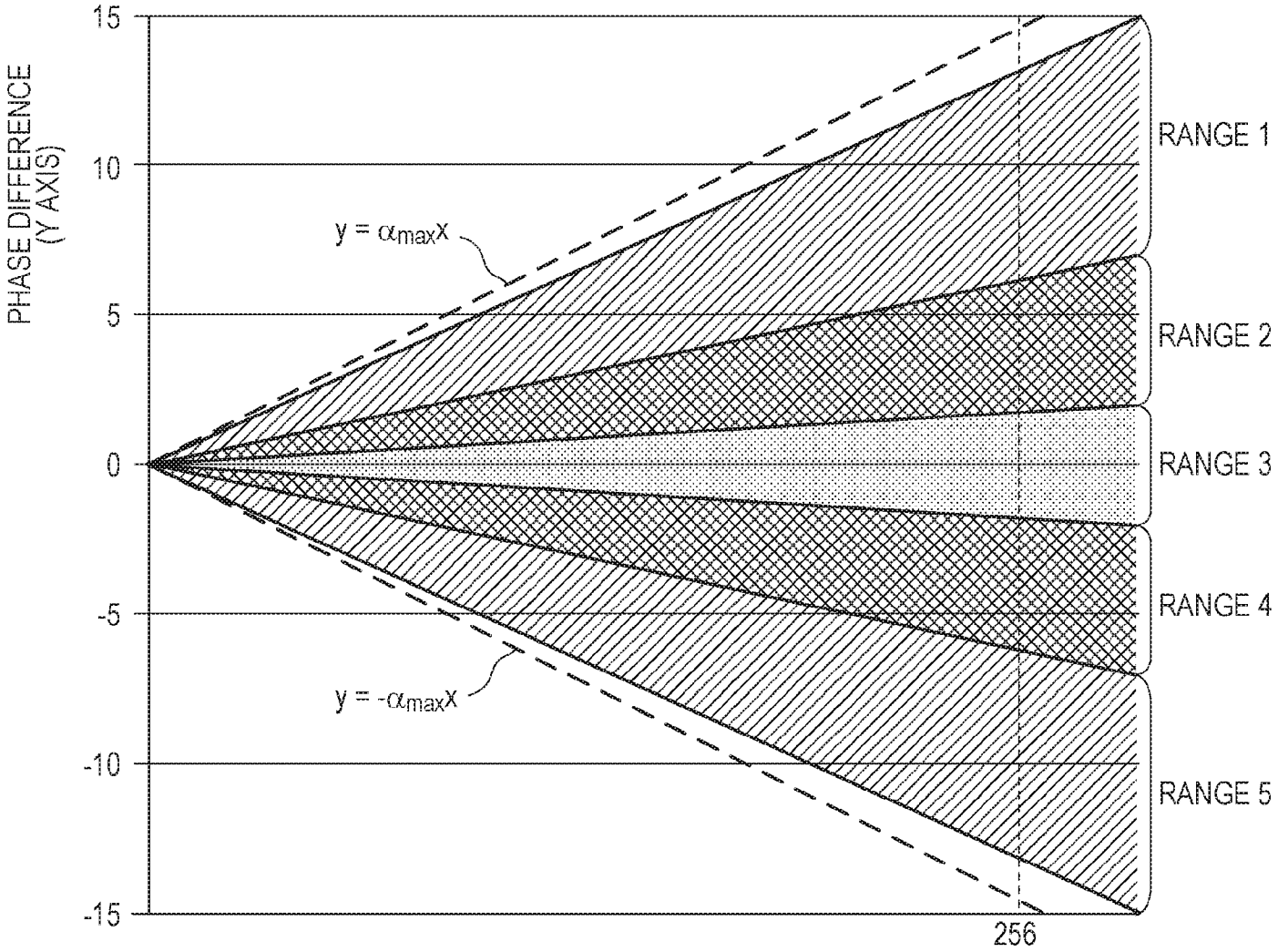
FIG. 4 is a diagram describing a second example of the range setting.

FIG. 4 is a diagram describing a second example of the range setting. Referring to FIG. 4, phase difference ranges are defined by pairs of adjacent boundary lines BL, and angles formed by the pairs of boundary lines BL defining the phase difference ranges are set to ensure that as phase differences included in a range are closer to "0", the angle formed by the boundary lines BL is smaller in the second example. In the second example, the range setting unit 4A may define the boundary lines BL so as to ensure that absolute values |α| of the inclinations α do not exceed the maximum value $\alpha_{max}$, similarly to the first example.

Figure 5:
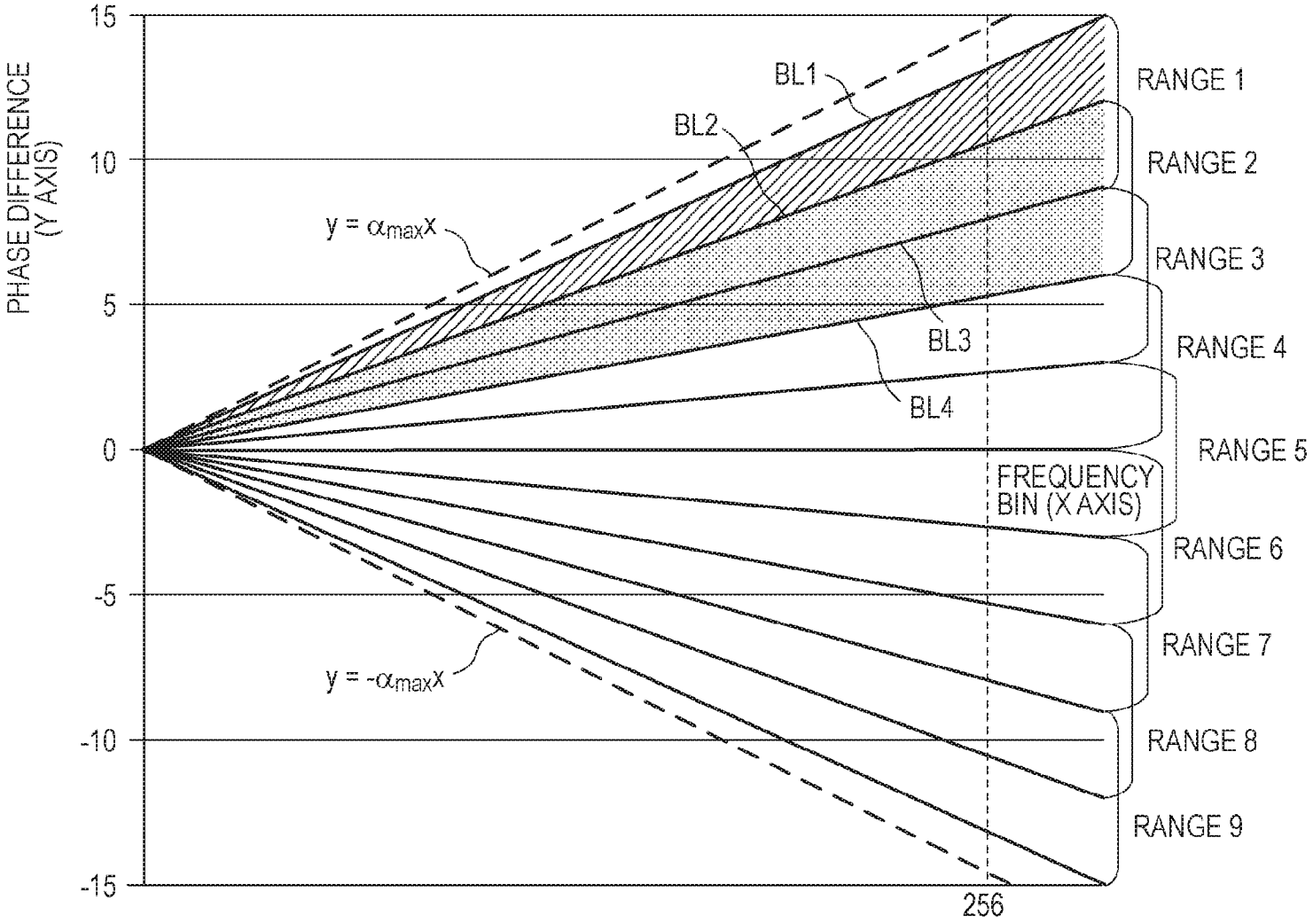
FIG. 5 is a diagram describing a third example of the range setting.

FIGS. 5 and 6 are diagrams describing a third example of the range setting. Referring to FIG. 5, phase difference ranges are set to ensure that each of the phase difference ranges includes a part overlapping a part of at least any of phase difference ranges adjacent to the phase difference range in the third example. In the third example, as illustrated in FIG. 6, the range setting unit 4A may set inclinations α1 of lower limit boundary lines BL defining the phase difference ranges and inclinations a2 of upper limit boundary lines BL defining the phase difference ranges and thereby set the phase difference ranges so as to ensure that each of the phase difference ranges includes a part overlapping a part of at least any of phase difference ranges adjacent to the phase difference range. In the third example, the range setting unit 4A may define the boundary lines BL so as to ensure that the absolute values |α| of the inclinations α do not exceed the maximum value $\alpha_{max}$, similarly to the first example. In this manner, by setting the phase difference ranges to ensure that each of the phase difference ranges includes a part overlapping a part of at least any of phase difference ranges adjacent to the phase difference range, data on the boundary lines may be included in any of the phase difference ranges and handled. Thus, the accuracy of estimating a phase difference range in which a sound source exists may be improved.

Figure 7:
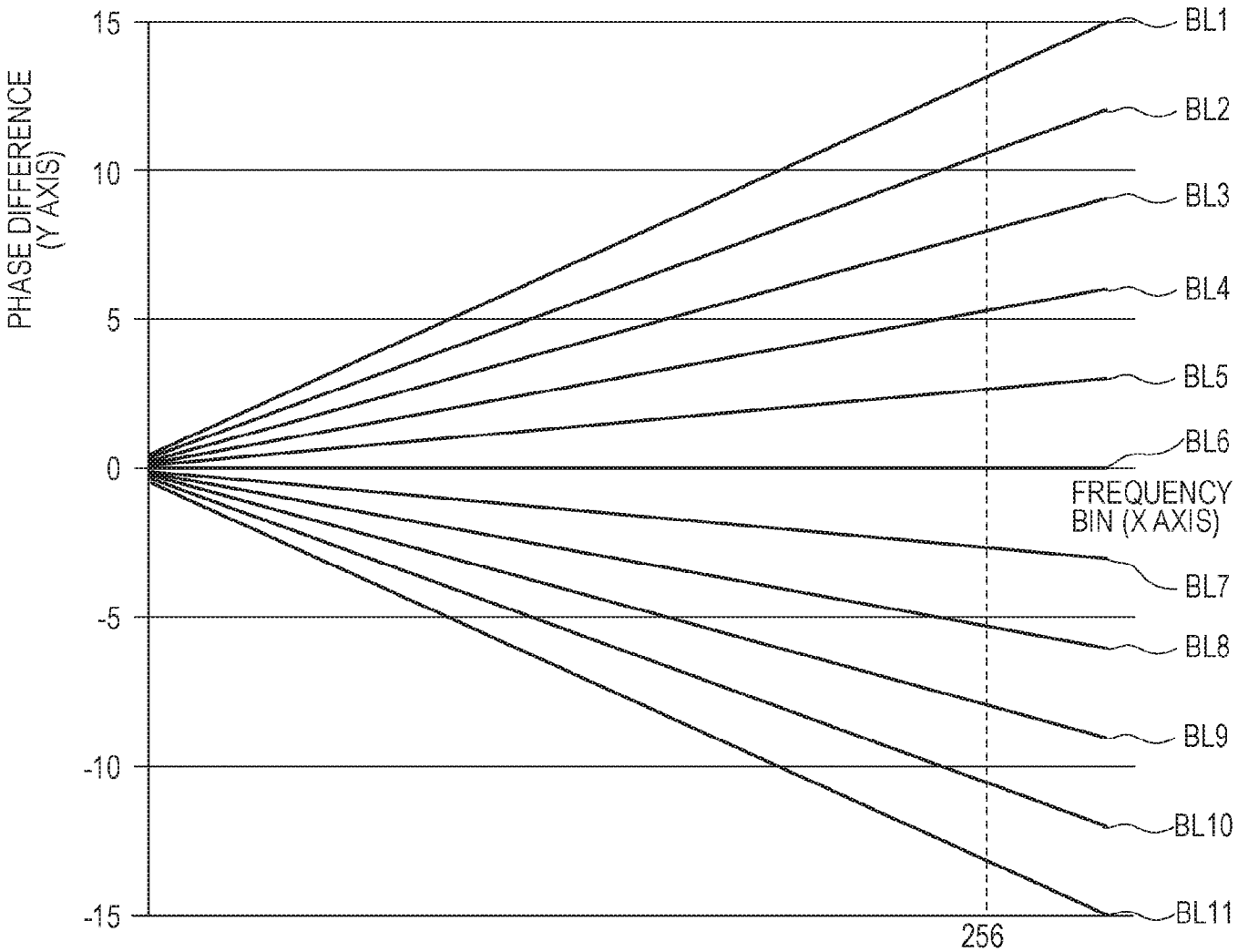
FIG. 7 is a diagram describing a fourth example of the range setting.

FIGS. 7 and 8 are diagrams describing a fourth example of the range setting. Referring to FIG. 7, at least some of y-intercepts β of the straight lines indicating boundary lines BL defining phase difference ranges is set to values other than "0" in the fourth example. For example, the range setting unit 4A may set, as the boundary lines BL, straight lines y=αx+β defined by combinations of inclinations α and y-intercepts β illustrated in FIG. 8 and thereby set the phase difference ranges by the boundary lines BL including boundary lines BL of which y-intercepts β are set to values other than "0". The method of defining the phase difference ranges by boundary lines BL indicated by straight lines having y-intercepts β set to values other than "0" is applicable to the aforementioned first to third examples.

Returning to FIGS. 1 and 2, the orthogonal transforming unit 4B divides each of the input signals in(t) after the digital conversion into frames. Then, the orthogonal transforming unit 4B executes orthogonal transform such as fast Fourier transform on the input signals in(t) divided into frames so as to convert the input signals in(t) in each of the frames into the frequency domain signal and generates input spectra X(f) composed of amplitude spectra |X(f)| and phase spectra argX(f) for each frequency (frequency bin). Then, the orthogonal transforming unit 4B outputs the generated amplitude spectra |X(f)| to the suppression processing unit 4H and outputs the phase spectra argX(f) to the phase difference calculator 4C and the inverse orthogonal transforming unit 4I.

The phase difference calculator 4C calculates, as phase differences, differences between phase spectra argX(f) for each the same frequency (or the same frequency bin). Then, the phase difference calculator 4C outputs the calculated phase differences to the additional data calculator 4D, the range selector 4E, and the identifying unit 4F, respectively as illustrated in FIG. 2.

The additional data calculator 4D calculates, as additional data, the phase differences±nπ (n is an even number) based on the input phase differences for the each frequency (frequency bin). Specifically, the additional data calculator 4D generates the additional data by rotating the phase in each the phase difference. Then, the additional data calculator 4D outputs the calculated additional data to the identifying unit 4F, as illustrated in FIG. 2. The even number n is defined by the following Equation 4.

$$n = \left\{\text{the minimum even number satisfying}\left(\frac{F_s \times D}{C} - 1 \le n\right)\right\} \quad \text{Equation 4}$$

For example, when the sound speed C is 340 m/s, the distance D between the microphones is 0.1 m, and the sampling frequency Fs is 8 kHz, n={the minimum even number satisfying (8000×0.1/340)−1=1.35≤n} or n=2. Thus, in this case, the additional data calculator 4D calculates the phase differences±2π as the additional data.

Based on the input phase differences, the range selector 4E selects, in a frequency band in which phase rotation does not occur, a phase difference range in which a sound source may exist at a high probability. Specifically, the range selector 4E acquires the range information and the maximum frequency bin Bmax obtained by expressing the maximum frequency Fmax in terms of the frequency bin, the maximum frequency Fmax being at which phase rotation does not occur. The range information and the maximum frequency bin Bmax are stored in the data area of the storage unit 20. Then, the range selector 4E selects, in the frequency band in which phase rotation does not occur, one or more phase difference ranges in which many phase differences exist. Then, the range selector 4E outputs the results of the selection to the identifying unit 4F as illustrated in FIG. 2.

For example, the range selector 4E may select, in the frequency band in which phase rotation does not occur, a main phase difference range in which the number of phase differences Nmax is the largest and select a secondary different phase difference range in which the number of phase differences is Ns, where (Nmax−Ns) is equal to or smaller than a predetermined first threshold Z1. In addition, for example, the range selector 4E may select, in the frequency band in which phase rotation does not occur, a main phase difference range in which the number of the phase differences Nmax is the largest and select a secondary phase difference range in which the number of phase differences is Ns, where the ratio Ns/Nmax is equal to or smaller than a predetermined second threshold Z2.

The identifying unit 4F identifies, among the phase difference ranges selected by the range selector 4E, a phase difference range in which the sound source exists, that is, the phase difference range exists in the direction toward the sound source. Specifically, the identifying unit 4F identifies, among the phase difference ranges selected by the range selector 4E, the phase difference range in which the number of phase differences and the phase differences±nπ (additional data) is larger than a predetermined third threshold Z3 in an entire frequency band. In this case, when the identifying unit 4F does not identify the phase difference range in which the number of phase differences and the phase differences±nπ (additional data) is larger than the predetermined third threshold Z3, the identifying unit 4F identifies, among the phase difference ranges selected by the range selector 4E and estimated as ranges in which the sound source may exist, a phase difference range in which the number of phase differences and the phase differences±nπ (additional data) is the largest in an entire frequency band. The accuracy of phase differences in a low-frequency band in which phase rotation does not occur is low. Thus, even when multiple phase difference ranges are selected, the identifying unit 4F may narrow down the selected phase difference ranges to a phase difference range in which the sound source may exist at a high probability by identifying the phase difference range in which the number of phase differences and the phase differences±nit π (additional data) is larger than the predetermined third threshold Z3. Then, the identifying unit 4F outputs the result of the identification to the suppression coefficient calculator 4G.

The suppression coefficient calculator 4G determines whether or not the sound source exists in the range (estimated phase difference range) in the direction toward the estimated sound source. Then, the suppression coefficient calculator 4G calculates, for each of the frequencies (frequency bins) based on the result of the determination, suppression coefficients G(f) to be used to suppress noise in the input signals in(t). Specifically, the suppression coefficient calculator 4G determines whether or not any of the phase differences and the additional data is included in the phase difference range identified by the identifying unit 4F in a middle- or high-frequency band that excludes the frequency band in which phase rotation does not occur or that is higher than the maximum frequency Fmax at which phase rotation does not occur. In this case, the suppression coefficient calculator 4G may determine whether or not any of the phase differences and the additional data is included in the phase difference range identified by the identifying unit 4F in the entire frequency band. Alternatively, the suppression coefficient calculator 4G may determine whether or not any of the phase differences and the additional data is included in the phase difference range identified by the identifying unit 4F in the middle- or high-frequency band higher than the maximum frequency Fmax at which phase rotation does not occur, and the suppression coefficient calculator 4G may determine whether or not the phase differences are included in the phase difference range identified by the identifying unit 4F in the low-frequency band that is equal to or lower than the maximum frequency Fmax at which phase rotation does not occur.

When any of the phase differences and the additional data is included in the phase difference range, the suppression coefficient calculator 4G calculates 1.0 as a suppression coefficient G(f). When the phase differences and the additional data are not included in the phase difference range, the suppression coefficient calculator 4G calculates Gmin as the suppression coefficient G(f), that is, G(f)=Gmin. Gmin is a value satisfying 0<Gmin<1 and is set based on the amount of noise to be suppressed. Then, the suppression coefficient calculator 4G outputs suppression coefficients G(f) calculated for each of the frequencies (frequency bins) to the suppression processing unit 4H.

When multiple phase difference ranges are identified by the identifying unit 4F, the suppression coefficient calculator 4G determines whether or not the sound source exists for each of the identified phase difference ranges, and the suppression coefficient calculator 4G calculates the suppression coefficients G(f) for each of the frequencies (frequency bins) based on the results of the determination. The suppression coefficients G(f) are to be used to suppress noise in the input signals in(t). Specifically, when a first phase difference range and a second phase difference range are identified by the identifying unit 4F, the suppression coefficient calculator 4G calculates suppression coefficients G(f) for the first phase difference range and calculates suppression coefficients G(f) for the second phase difference range.

The suppression processing unit 4H multiplies the input amplitude spectra |X(f)| by the input suppression coefficients G(f) and calculates amplitude spectra |Y(f)| after the suppression for each of the frequencies (frequency bins) according to the following Equation 5. Then, the suppression processing unit 4H outputs the calculated amplitude spectra |Y(f)| after the suppression to the inverse orthogonal transforming unit 4I, as illustrated in FIG. 2. When the multiple phase difference ranges are identified by the identifying unit 4F, the suppression processing unit 4H multiplies amplitude spectra |X(f)| by corresponding suppression coefficients G(f) for each of the identified phase difference ranges and calculates amplitude spectra |Y(f)| after the suppression for each of the frequencies (frequency bins).

$$|Y(f)|=G(f)\times|X(f)| \quad \text{Equation 5}$$

The inverse orthogonal transforming unit 4I executes inverse orthogonal transform on the input phase spectra arg X(f) and the amplitude spectra |Y(f)| after the suppression and thereby generates an output signal out(t) in the time domain. Then, the inverse orthogonal transforming unit 4I outputs the generated output signal out(t) through the output unit 30.

When the multiple phase difference ranges are identified by the identifying unit 4F, the inverse orthogonal transforming unit 4I executes the inverse orthogonal transform on the input phase spectra arg X(f) and the amplitude spectra |Y(f)| after the suppression that correspond to the input phase spectra arg X(f) for the identified phase difference ranges and thereby generates the output signal out(t) in the time domain. Specifically, when the multiple phase difference ranges are identified by the identifying unit 4F, the inverse orthogonal transforming unit 4I generates, for the identified phase difference ranges, the output signals out(t) in which a sound whose sound source exists in another range is suppressed. In this case, the inverse orthogonal transforming unit 4I outputs the output signals out(t) selected by a user through the output unit 30, for example.

Figure 9:
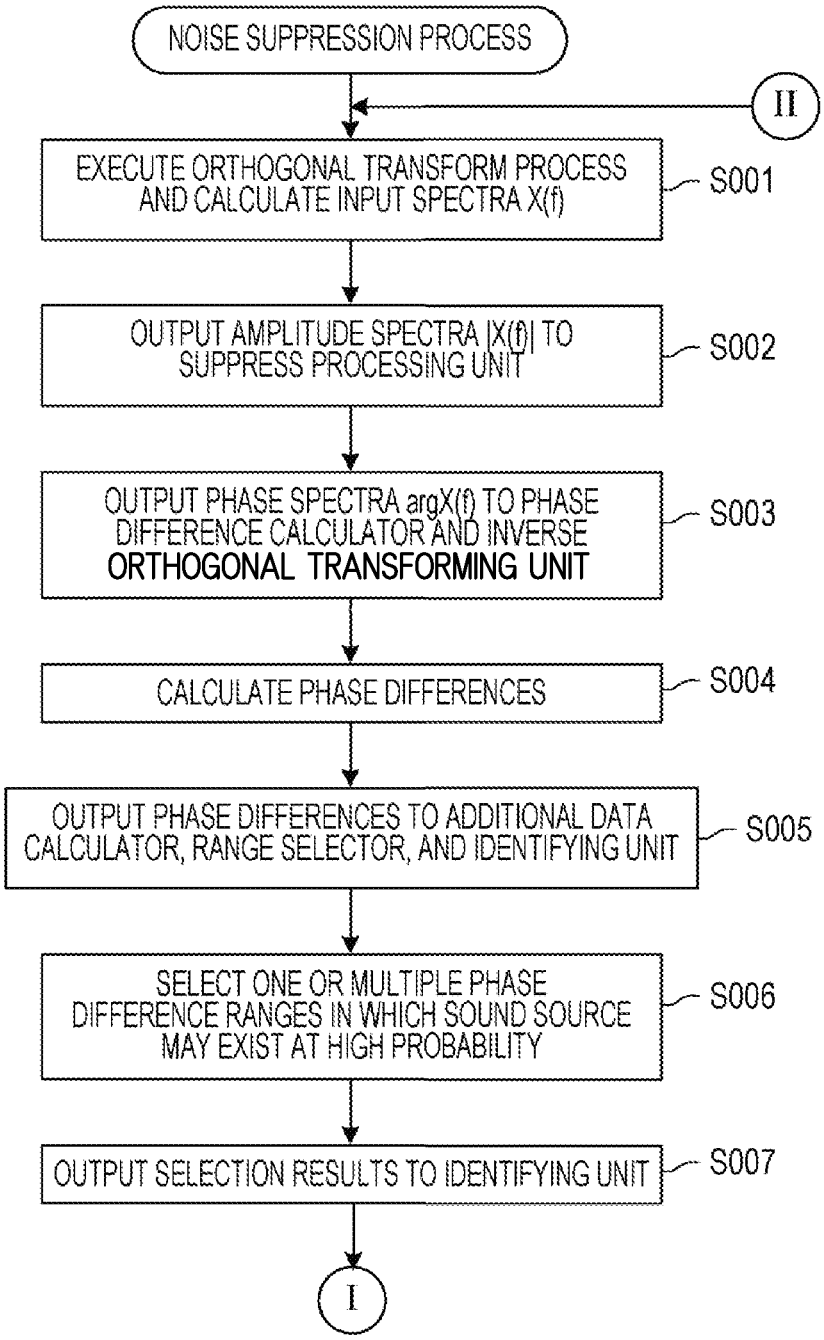
FIG. 9 is a part of an example of a flowchart of a noise suppression process according to the first embodiment.
Figure 10:
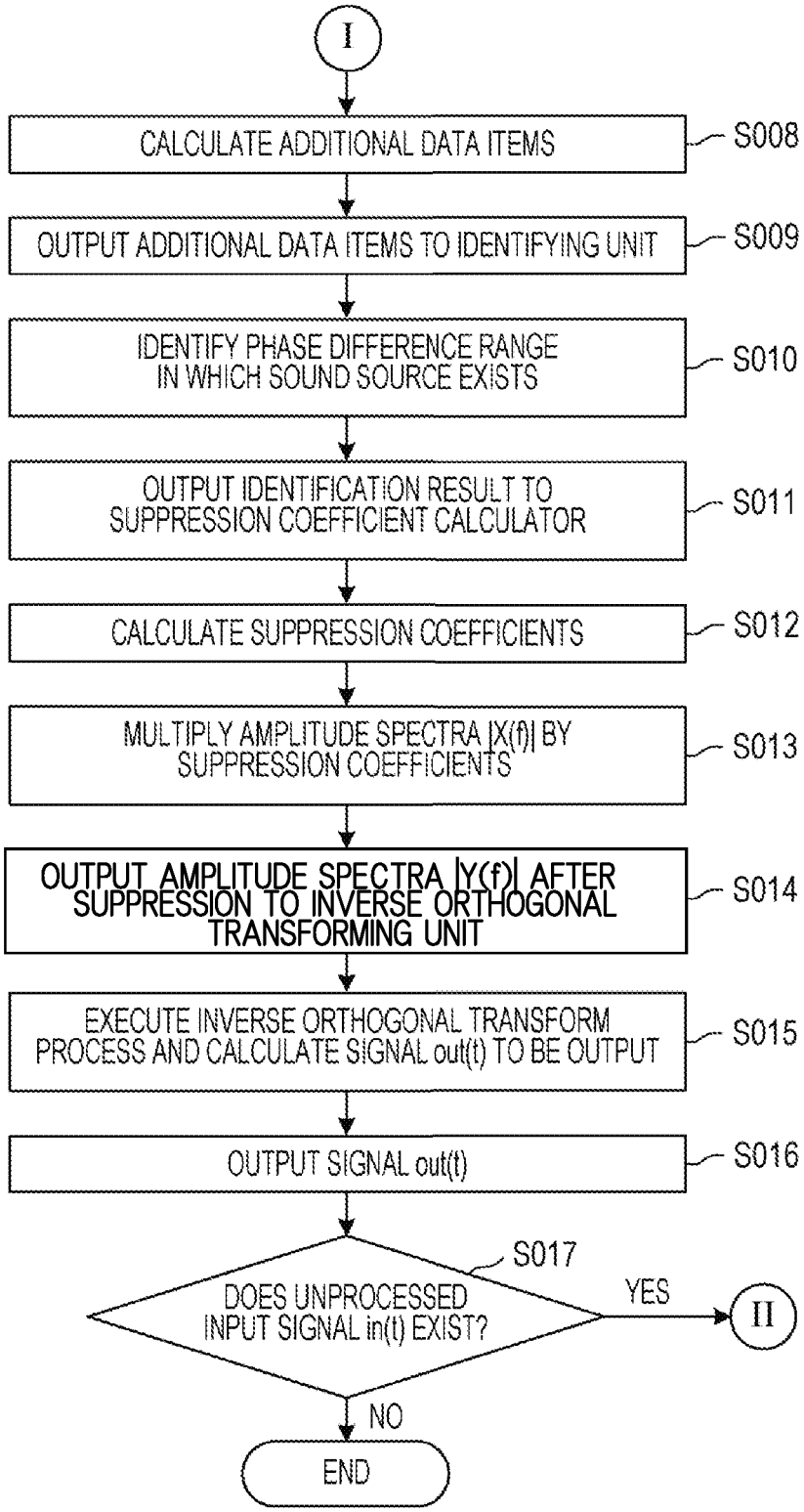
FIG. 10 is the other part of the example of the flowchart of the suppression process according to the first embodiment.

Next, the flow of a noise suppression process according to the first embodiment is described with reference to FIGS. 9 and 10. FIG. 9 is a part of an example of a flowchart describing the flow of the noise suppression process according to the first embodiment, while FIG. 10 is the other part of the example of the flowchart. The noise suppression process is started when the signals in(t) are input.

The orthogonal transforming unit 4B executes an orthogonal transform process on input signals in(t) and generates input spectra X(f) composed of amplitude spectra |X(f)| and phase spectra argX(f) for each of the frequencies (frequency bins) (in step S001). Then, the orthogonal transforming unit 4B outputs the generated amplitude spectra |X(f)| to the suppression processing unit 4H (in step S002) and outputs the phase spectra argX(f) to the phase difference calculator 4C and the inverse orthogonal transforming unit 4I (in step S003).

Then, the phase difference calculator 4C calculates, as a phase difference, a difference between phase spectra argX(f) of the same frequency (or the same frequency bin) for each of the frequencies (frequency bins) (in step S004). Then, the phase difference calculator 4C outputs the calculated phase differences to the additional data calculator 4D, the range selector 4E, and the identifying unit 4F (in step S005).

Then, the range selector 4E selects, based on the input phase differences, one or multiple phase difference ranges in which a sound source may exist at a high probability in the frequency band in which phase rotation does not occur (in step S006). Then, the range selector 4E outputs the results of the selection to the identifying unit 4F (in step S007).

Then, the additional data calculator 4D calculates the phase difference±nπ (additional data) based on the input phase difference for each of the frequencies (frequency bins) (in step S008). Then, the additional data calculator 4D outputs the calculated additional data to the identifying unit 4F (in step S009).

Then, the identifying unit 4F identifies a phase difference range that is among the phase difference ranges selected by the range selector 4E and in which the sound source exists (in step S010). In the first embodiment, the identifying unit 4F identifies a phase difference range that is among the phase difference ranges selected by the range selector 4E and in which the number of the phase differences and the phase differences±nπ (additional data) is larger than the predetermined third threshold Z3. Then, the identifying unit 4F outputs the result of the identification to the suppression coefficient calculator 4G (in step S011).

Then, the suppression coefficient calculator 4H calculates, for each of the frequencies (frequency bins), suppression coefficient G(f) to be used to suppress noise in the input signal in(t) and outputs the calculated suppression coefficient G(f) to the suppression processing unit 4H (in step S012).

Then, the suppression processing unit 4H multiplies the amplitude spectra |X(f)| by the suppression coefficients G(f) and thereby calculates amplitude spectra |Y(f)| after the suppression for each of the frequencies (frequency bins) (in step S013). Then, the suppression processing unit 4H outputs the calculated amplitude spectra |Y(f)| after the suppression to the inverse orthogonal transforming unit 4I (in step S014).

Then, the inverse orthogonal transforming unit 4I executes the inverse orthogonal transform on the phase spectra argX(f) and the amplitude spectra |Y(f)| after the suppression and generates an output signal out(t) in the time domain (in step S015). Then, the inverse orthogonal transforming unit 4I outputs the output signal out(t) through the output unit 30 (in step S016).

Then, the controller 40 determines whether or not an input signal in(t) that is yet to be processed exists (in step S017). When the controller 40 determines that the input signal in(t) that is yet to be processed exists (Yes in step S017), the process returns to the process of step S001 in FIG. 9 and the aforementioned processes are repeated. On the other hand, when the controller 40 determines that the input signal in(t) that is yet to be processed does not exist (No in step S017), the process is terminated.

Next, a method of identifying a phase difference range in which a sound source may exist at the highest probability is described with reference to specific examples illustrated in FIGS. 11 to 16.

Figure 11:
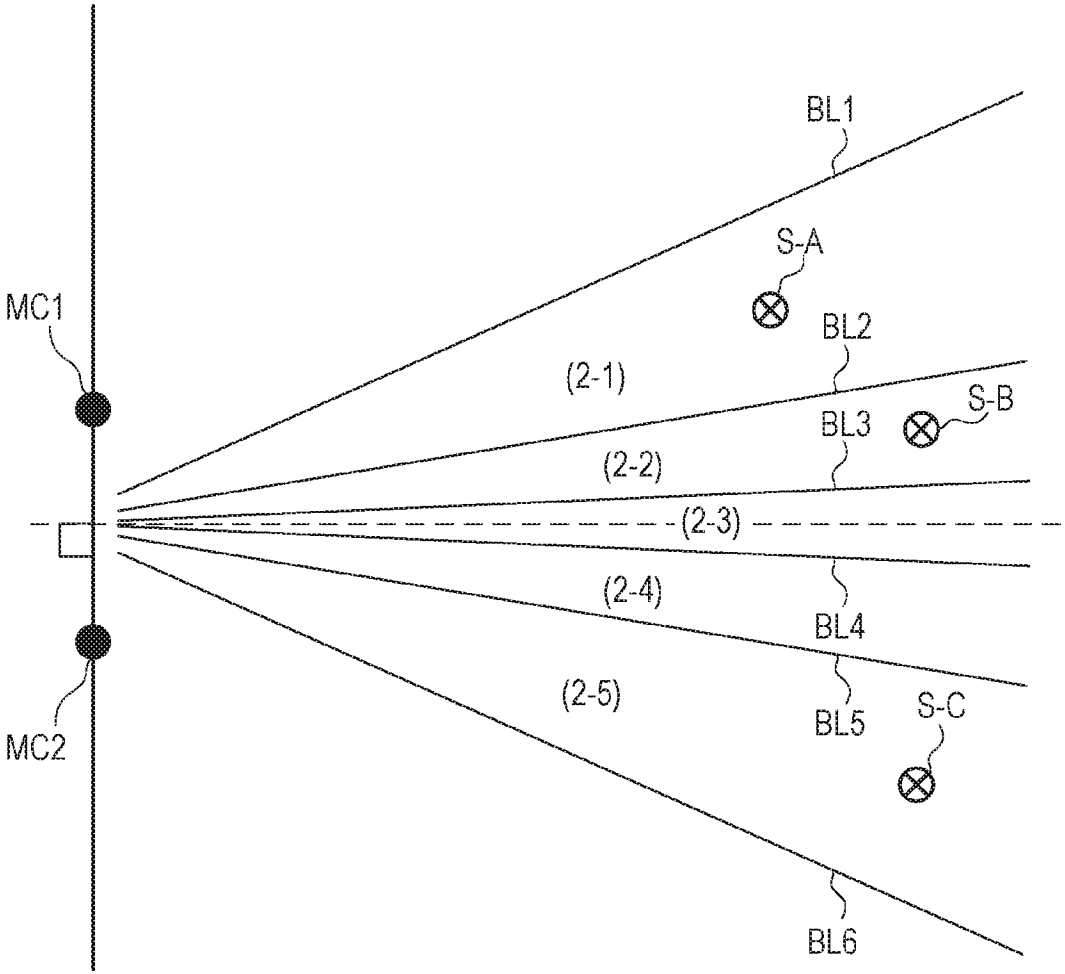
FIG. 11 is a diagram illustrating a first specific example describing the noise suppression process according to the first embodiment.

FIG. 11 is a diagram illustrating a first specific example describing the noise suppression process according to the first embodiment. As illustrated in FIG. 11, the first specific example assumes that three sound sources (first sound source S-A, second sound source S-B, and third sound source S-C) exist. For more details, the first sound source S-A exists in a phase difference range (2-1) between boundary lines BL1 and BL2, the second sound source S-B exists in a phase difference range (2-2) between boundary lines BL2 and BL3, and the third sound source S-C exists in a phase difference range (2-5) between boundary lines BL5 and BL6. In addition, the first specific example assumes that the sound sources generate sounds at different times and that n=2.

Figure 12:
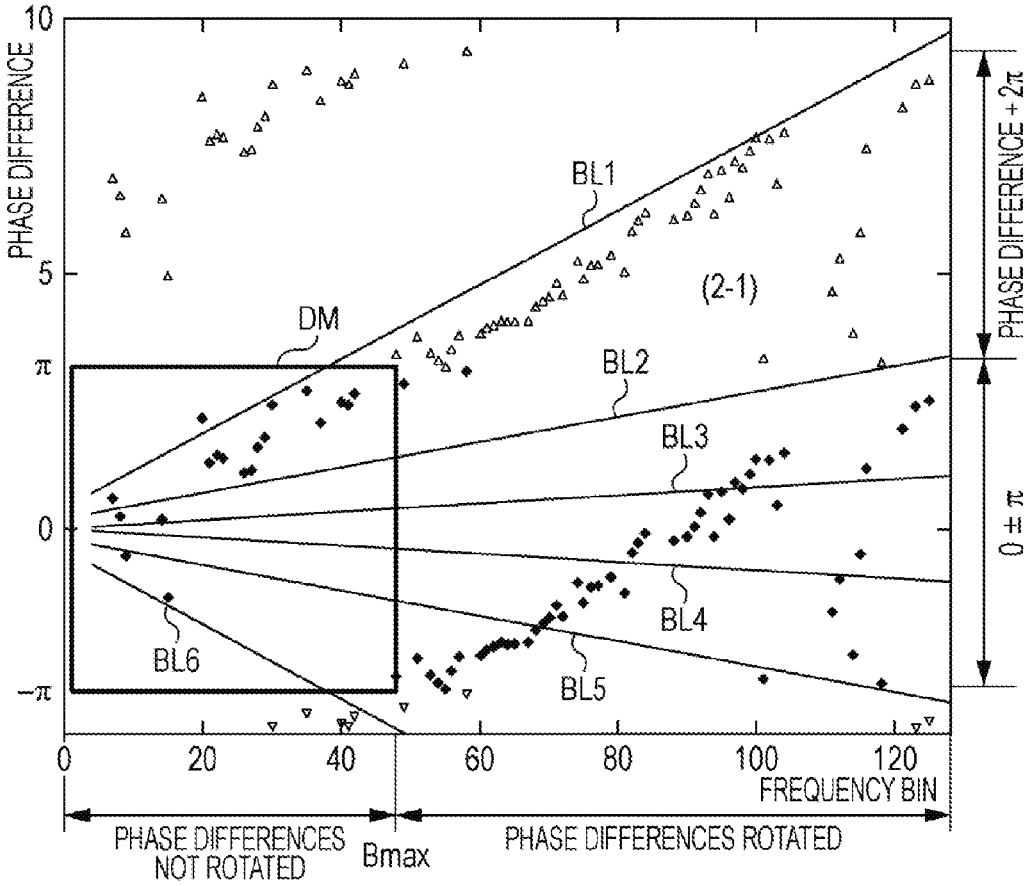
FIG. 12 is a diagram describing a method of identifying a first sound source in the first specific example.
Figure 13:
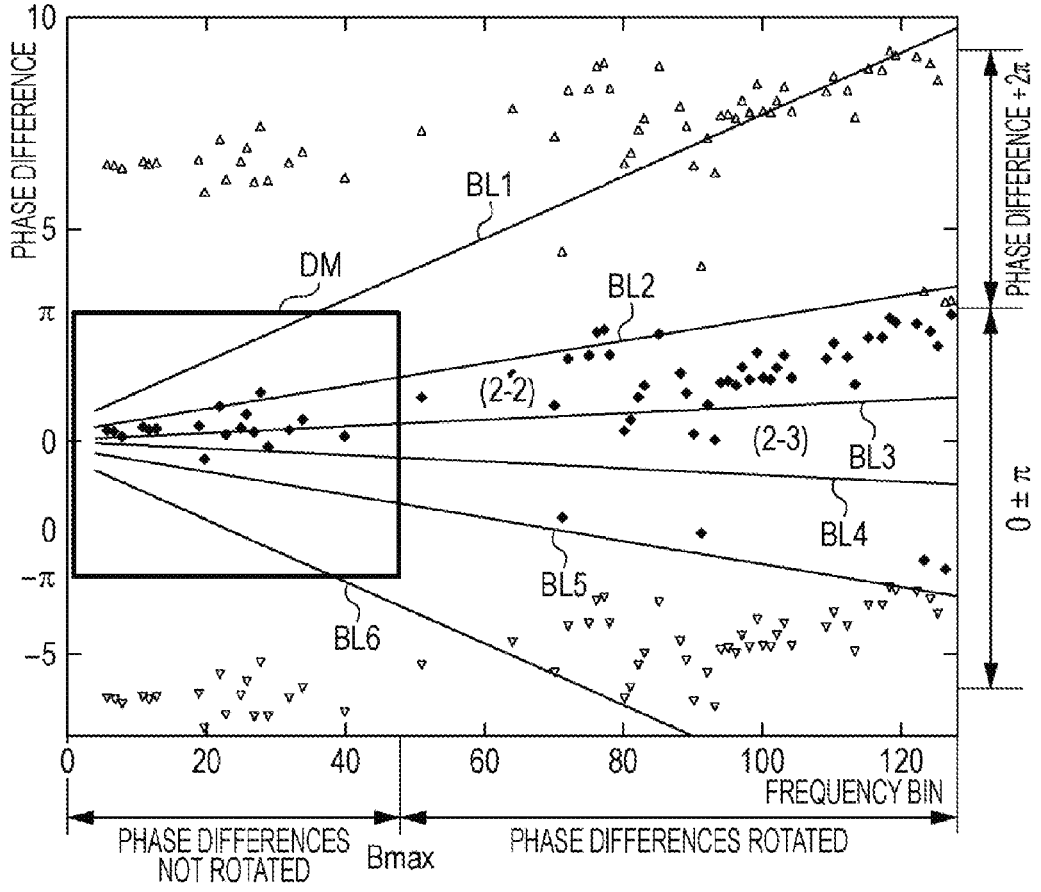
FIG. 13 is a diagram describing a method of identifying a second sound source in the first specific example.
Figure 14:
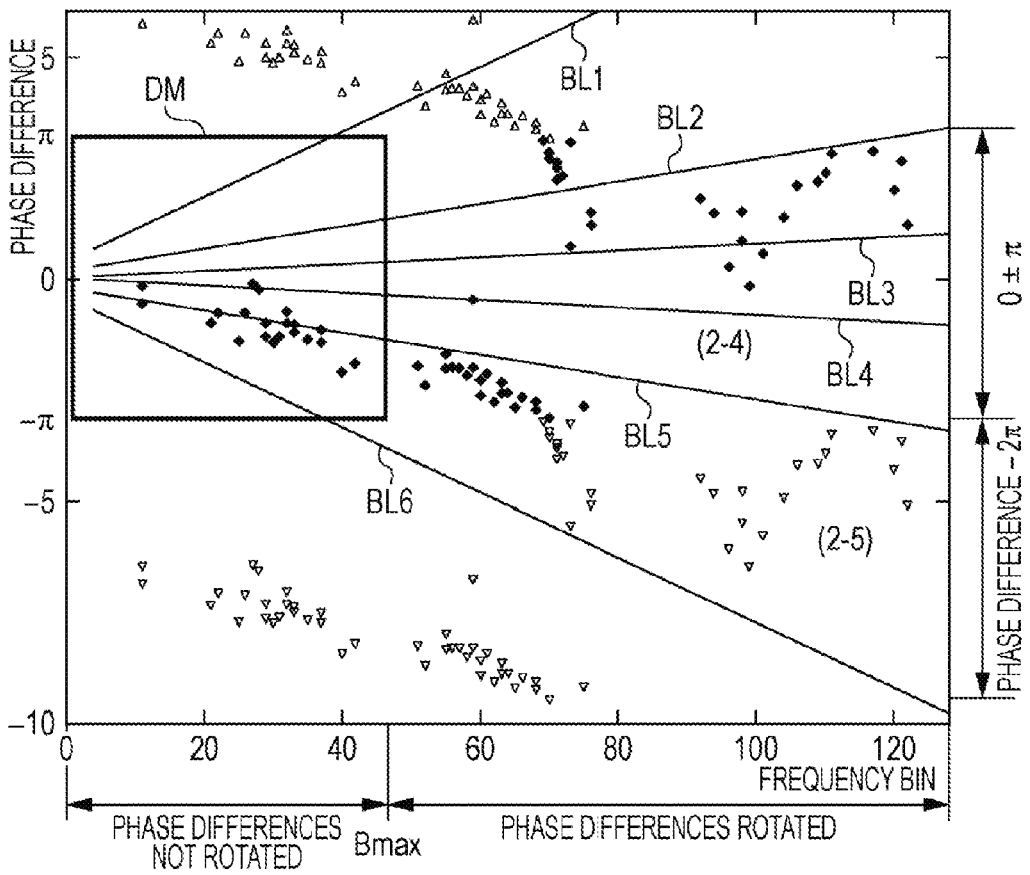
FIG. 14 is a diagram describing a third sound source in the first specific example.

FIG. 12 is a diagram describing a method of identifying the first sound source S-A in the first specific example. FIG. 13 is a diagram describing a method of identifying the second sound source S-B in the first specific example. FIG. 14 is a diagram describing a method of identifying the third sound source S-C in the first specific example.

In FIGS. 12, 13, 14, and 16, points indicated by a black diamond shape indicate phase differences calculated by the phase difference calculator 4C, and points indicated by a triangular shape indicate the phase differences±nπ or additional data. In addition, the coordinates of points indicated by the black diamond shape indicate phase differences at a certain time, the coordinates of points indicated by an upward triangle indicate the phase differences+2π at the certain time, and the coordinates of points indicated by a downward triangle indicate the phase differences−2π. In FIGS. 12, 13, 14, and 16, a range DM indicates a range in which phase rotation does not occur.

First, the method of identifying the first sound source S-A is described with reference to FIG. 12. In the first specific example, in the frequency band in which phase rotation does not occur, the number of points indicative of phase difference within the phase difference range (2-1) between the boundary lines BL1 and BL2 is the largest, as illustrated in FIG. 12. Thus, the range selector 4E selects the phase difference range (2-1) . In the first specific example, since few points indicative of phase difference phase differences exist in each of other phase difference ranges as illustrated in FIG. 12, and the range selector 4E selects only the phase difference range (2-1) . In this case, the identifying unit 4F identifies the phase difference range (2-1) as a phase difference range in which the number of the points indicative of phase difference and phase difference±nπ (additional data) is the largest. In this manner, the identifying unit 4F may coordinate with the range selector 4E and estimate the phase difference range (2-1) in which the first sound source S-A exists.

Next, the method of identifying the second sound source S-B is described with reference to FIG. 13. In the first specific example, in the frequency band in which phase rotation does not occur, the number of points indicative of phase difference within the phase difference range (2-2)

between the boundary lines BL2 and BL3 is the largest, as illustrated in FIG. 13. Thus, the range selector 4E selects the phase difference range (2-2) . The first specific example assumes that a phase difference range (2-3) between the boundary line BL3 and a boundary line BL4 satisfies the aforementioned predetermined requirements. In this case, the range selector 4E selects the phase difference range (2-2) and the phase difference range (2-3).

It is assumed that a phase difference range in which the number of points indicative of either phase differences or the phase differences±nπ that are additional data is larger than the predetermined third threshold Z3 is only the phase difference range (2-2). In this case, the identifying unit 4F identifies the phase difference range (2-2) among the phase difference ranges (2-2) and (2-3). In this manner, the identifying unit 4F may coordinate with the range selector 4E and estimate the phase difference range (2-2) in which the second sound source S-B exists.

Next, the method of identifying the third sound source S-C is described with reference to FIG. 14. In the first specific example, in the frequency band in which phase rotation does not occur, the number of points indicative of phase differences within the phase difference range (2-5) between the boundary lines BL5 and BL6 is the largest, as illustrated in FIG. 14. Thus, the range selector 4E selects the phase difference range (2-5). The first specific example assumes that the phase difference range (2-4) between the boundary lines BL4 and BL5 satisfies the aforementioned predetermined requirements. In this case, the range selector 4E selects the phase difference ranges (2-5) and (2-4).

It is assumed that a phase difference range in which the number of points indicative of either phase differences or the phase differences±nπ that are additional data is larger than the predetermined third threshold Z3 is only the phase difference range (2-5). In this case, the identifying unit 4F identifies the phase difference range (2-5) among the phase difference ranges (2-4) and (2-5). In this manner, the identifying unit 4F may coordinate with the range selector 4E to estimate the phase difference range (2-5) in which the third sound source S-C exists.

Figure 15:
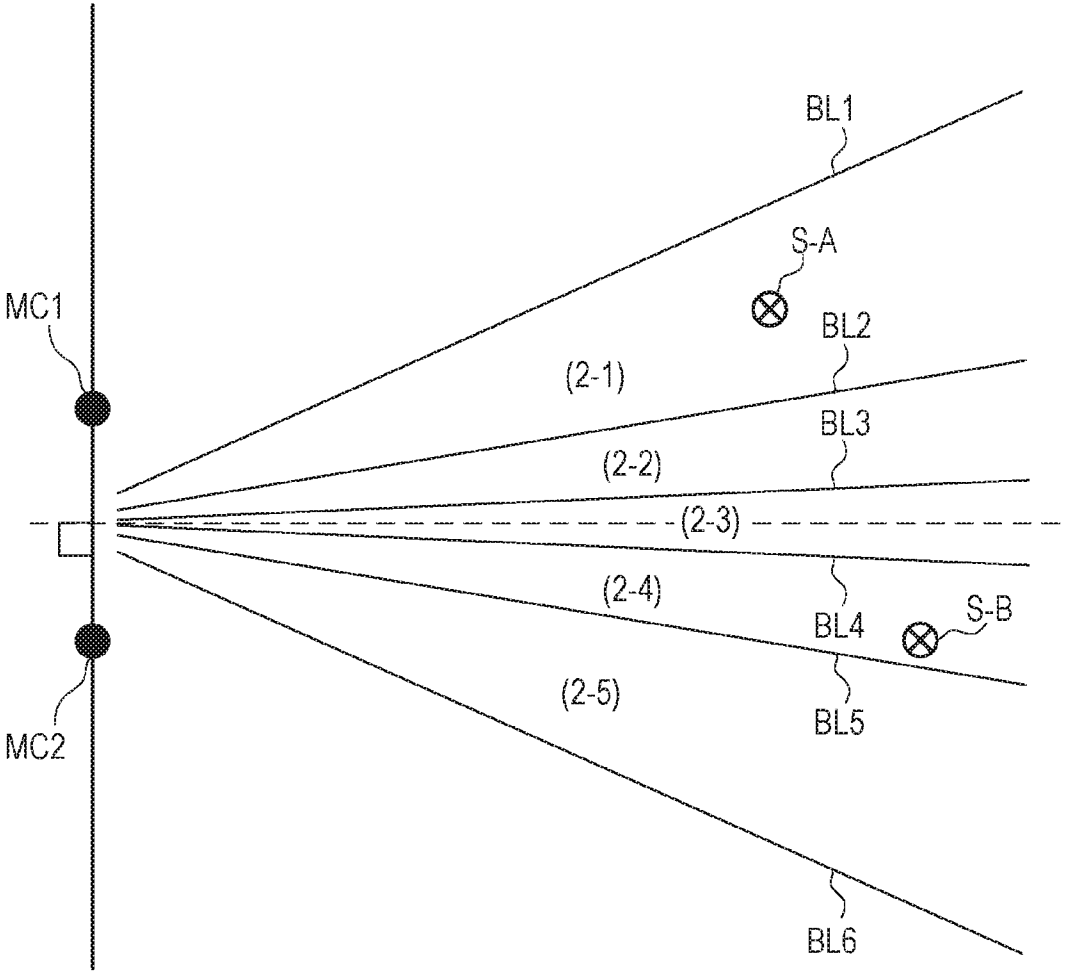
FIG. 15 is a diagram illustrating a second specific example describing the noise suppression process according to the first embodiment.
Figure 16:
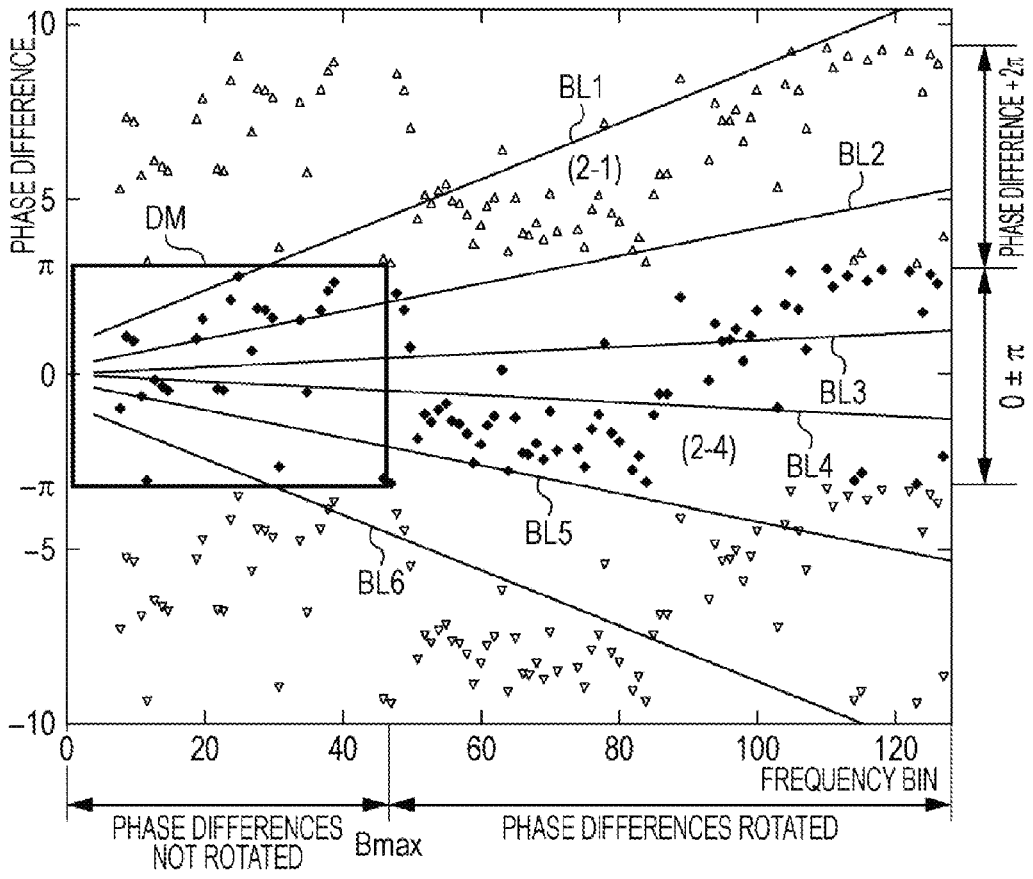
FIG. 16 is a diagram describing a method of identifying a sound source in the second specific example.

FIG. 15 is a diagram illustrating a second specific example describing the noise suppression process according to the first embodiment. As illustrated in FIG. 15, the second specific example assumes that the two sound sources (first sound source S-A and second sound source S-B) exist. For more detail, the second specific example assumes that the first sound source S-A exists in the phase difference range (2-1) and the second sound source S-B exists in the phase differenced range (2-4). Further, the second specific example assumes that the sound sources simultaneously generate sounds and that n=2. FIG. 16 is a diagram describing a method of identifying the sound sources in the second specific example.

In the second specific example, in the frequency band in which phase rotation does not occur, the number of the points indicative of phase difference within the phase difference range (2-1) is the largest, as illustrated in FIG. 16. Thus, the range selector 4E selects the phase difference range (2-1). The second specific example assumes that the phase difference range (2-4) satisfies the aforementioned predetermined requirements. In this case, the range selector 4E selects the phase difference ranges (2-1) and (2-4).

It is assumed that the number of the points of either phase difference or the phase difference±nπ that are additional data is larger than the predetermined third threshold Z3 in each of the phase difference ranges (2-1) and (2-4). In this case, the identifying unit 4F identifies the two phase difference ranges (2-1) and (2-4) as phase difference ranges in which the sound sources exist. In this manner, the identifying unit 4F may coordinate with the range selector 4E and estimate, as the phase difference ranges in which the sound sources exist, the phase difference range (2-1) in which the first sound source S-A exists and the phase difference range (2-4) in which the second sound source S-B exists. Thus, even when multiple sound sources simultaneously generate sounds, the identifying unit 4F may estimate phase difference ranges in which the sound sources exist.

Next, effects that are obtained when the noise suppression technique according to the first embodiment is applied are described with reference to FIGS. 17A and 17B. FIGS. 17A and 17B are diagrams describing the effects of the noise suppression process according to the first embodiment. Conditions upon the execution of evaluation are as follows.

(Condition 1) A microphone array is installed at the center of a square having sides of approximately 2 meters in an acoustic booth.

(Condition 2) Noise is output from four speakers installed at corners of the square.

(Condition 3) A target sound is output from a position separated by approximately 0.1 meters from the microphone array.

(Condition 4) A distance D between microphones included in the microphone array is approximately 0.1 meters, and the difference between the sensitivities of the microphones is large.

As illustrated in FIG. 17A, in a conventional technique 1 that has been proposed in Japanese Laid-open Patent Publication No. 2014-137414 and is to suppress noise using a phase difference and an amplitude ratio, noise may be suppressed in both low-frequency band equal to or lower than the maximum frequency Fmax at which phase rotation does not occur and middle- or high-frequency band higher than the maximum frequency Fmax, but an output signal out(t) after suppression may be distorted, as described later in detail. In a conventional technique 2 using only a phase difference, distortion of an output signal out(t) after suppression is smaller than the conventional technique 1, but noise is not suppressed in the middle- or high-frequency band higher than the maximum frequency Fmax, as described later in detail.

In the noise suppression technique according to the first embodiment, however, noise may be suppressed in both low-frequency band equal to or lower than the maximum frequency Fmax and middle- or high-frequency band higher than the maximum frequency Fmax, and distortion of an output signal out(t) after the noise suppression is smaller than the conventional technique 1.

FIG. 17B illustrates an example of actual suppression amount of noise upon the evaluation in conditions in which the suppression amounts of stationary noise by the conventional techniques 1 and 2 and the present method are almost equal to each other. In the example illustrated in FIG. 17B, the suppression amount of non-stationary noise suppressed by the noise suppression technique according to the first embodiment is 6.7 dB and is the largest, and the accuracy of suppressing noise by the noise suppression technique according to the first embodiment is the highest. In addition, a sound suppression amount suppressed by the noise suppression technique according to the first embodiment is 1.7 dB and is much lower than 3.7 dB that is the sound suppression suppressed by the conventional technique 1, and distortion of an output signal out(t) after the noise suppression according to the first embodiment is smaller than the conventional technique 1.

According to the aforementioned first embodiment, the noise suppression device 1 generates the additional data obtained by rotating the phase differences based on the differences between the phases of the signals input from the multiple microphones MC for each frequency. Then, the noise suppression device 1 selects, based on the phase differences in the frequency band in which the phase differences are not rotated, one or multiple phase difference ranges in which the sound source of the target sound included in the input signals may exist at a high probability. Then, the noise suppression device 1 estimates, based on the phase differences and the additional data, a phase difference range that is among the selected one or multiple phase difference ranges and exists in a direction toward the sound source. Then, the noise suppression device 1 generates a signal out(t) in which the noise included in the input signals in(t) is suppressed, based on suppression coefficients G(f) set based on whether or not the sound is input from the phase difference range in which the sound source exists. Thus, even when the distance between the microphones is large and the difference between the sensitivities of the microphones is large, the noise suppression device 1 may suppress noise while suppressing distortion of the target sound (voice).

<Second Embodiment>

In the first embodiment, the noise suppression device 1 estimates a range in which a sound source exists and that is among phase difference ranges between pairs of adjacent boundary lines BL. In the second embodiment, when the range selector 4E selects multiple phase difference ranges and a phase difference range that is adjacent to a phase difference range identified by an identifying unit 4F is any of the phase difference ranges selected by the range selector 4E, the identifying unit 4F identifies, as a range in which a sound source exists, a range that is within the adjacent phase difference range and corresponds to the low-frequency band equal to or lower than the maximum frequency Fmax at which phase rotation does not occur. Thus, phase difference ranges that correspond to the low-frequency band in which the accuracy of phase differences is low may be set to be large, while phase difference ranges that corresponds to the middle- or high-frequency band in which the accuracy of phase differences is high may be set to be small. Thus, the accuracy of suppressing noise may be improved.

Figure 18:
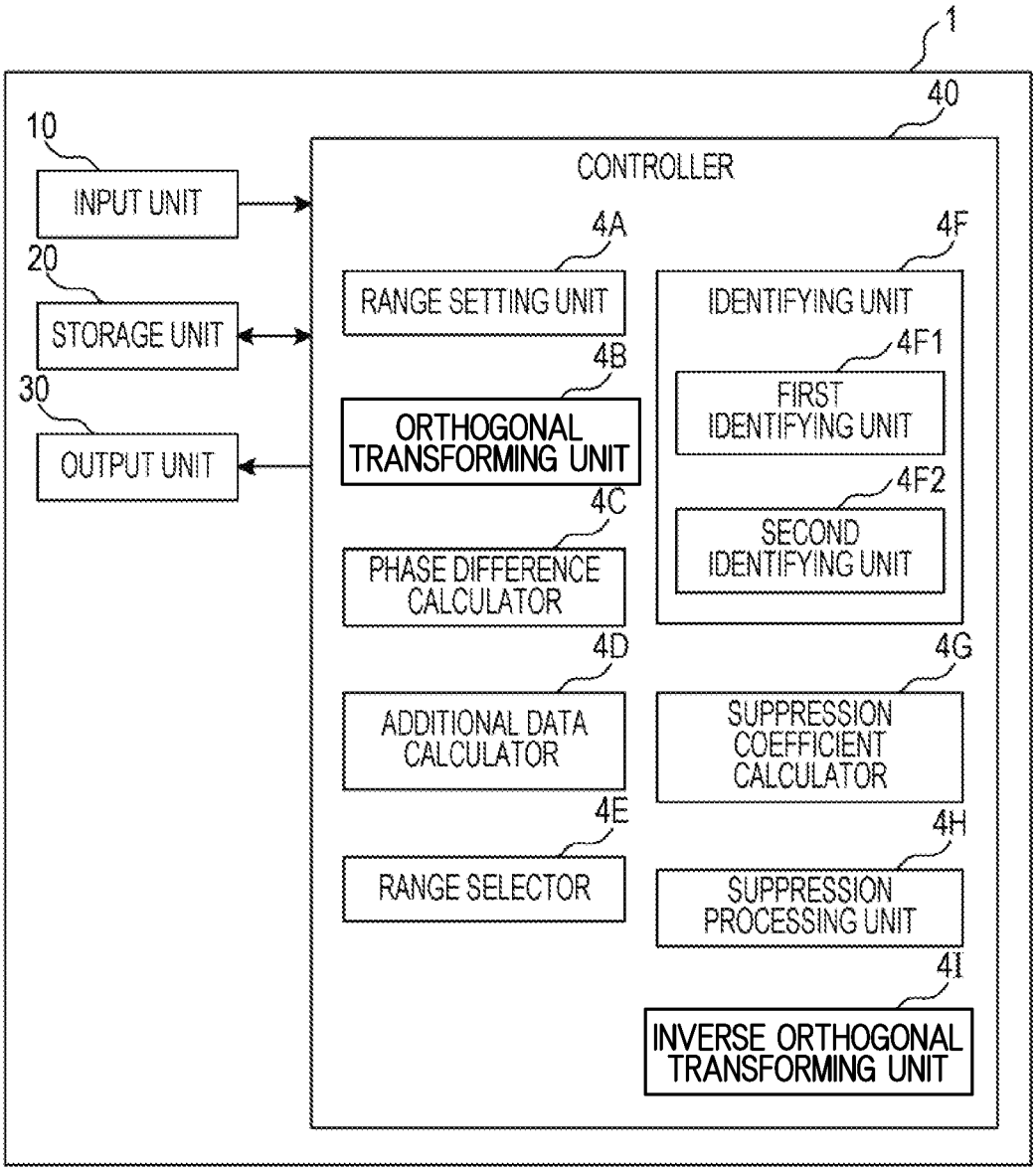
FIG. 18 is a functional block diagram illustrating an example of a configuration of a noise suppression device according to a second embodiment.

FIG. 18 is a functional block diagram illustrating an example of a configuration of a noise suppression device 1 according to the second embodiment. A basic configuration of the noise suppression device 1 according to the second embodiment is the same as that described in the first embodiment. The identifying unit 4F of the noise suppression device 1 according to the second embodiment includes a first identifying unit 4F1 and a second identifying unit 4F2, which is different from the identifying unit 4F described in the first embodiment.

The identifying unit 4F identifies a phase difference range that is among phase difference ranges selected by the range selector 4E and in which a sound source exists. The first identifying unit 4F1 according to the second embodiment is a functional unit corresponding to the identifying unit 4F according to the first embodiment. When the range selector 4E selects multiple phase difference ranges, the second identifying unit 4F2 determines whether or not at least any of the phase difference ranges selected by the range selector 4E is a phase difference range that is adjacent to the phase difference range identified by the first identifying unit 4F1. When at least any of the phase difference ranges selected by the range selector 4E is the phase difference range that is adjacent to the phase difference range identified by the first identifying unit 4F1, the second identifying unit 4F2 identifies, as a phase difference range in which the sound source exists, a phase difference range that is within the phase difference range adjacent to the phase difference range identified by the first identifying unit 4F1 and corresponds to the low-frequency band equal to or lower than the maximum frequency Fmax at which phase rotation does not occur.

Figure 19:
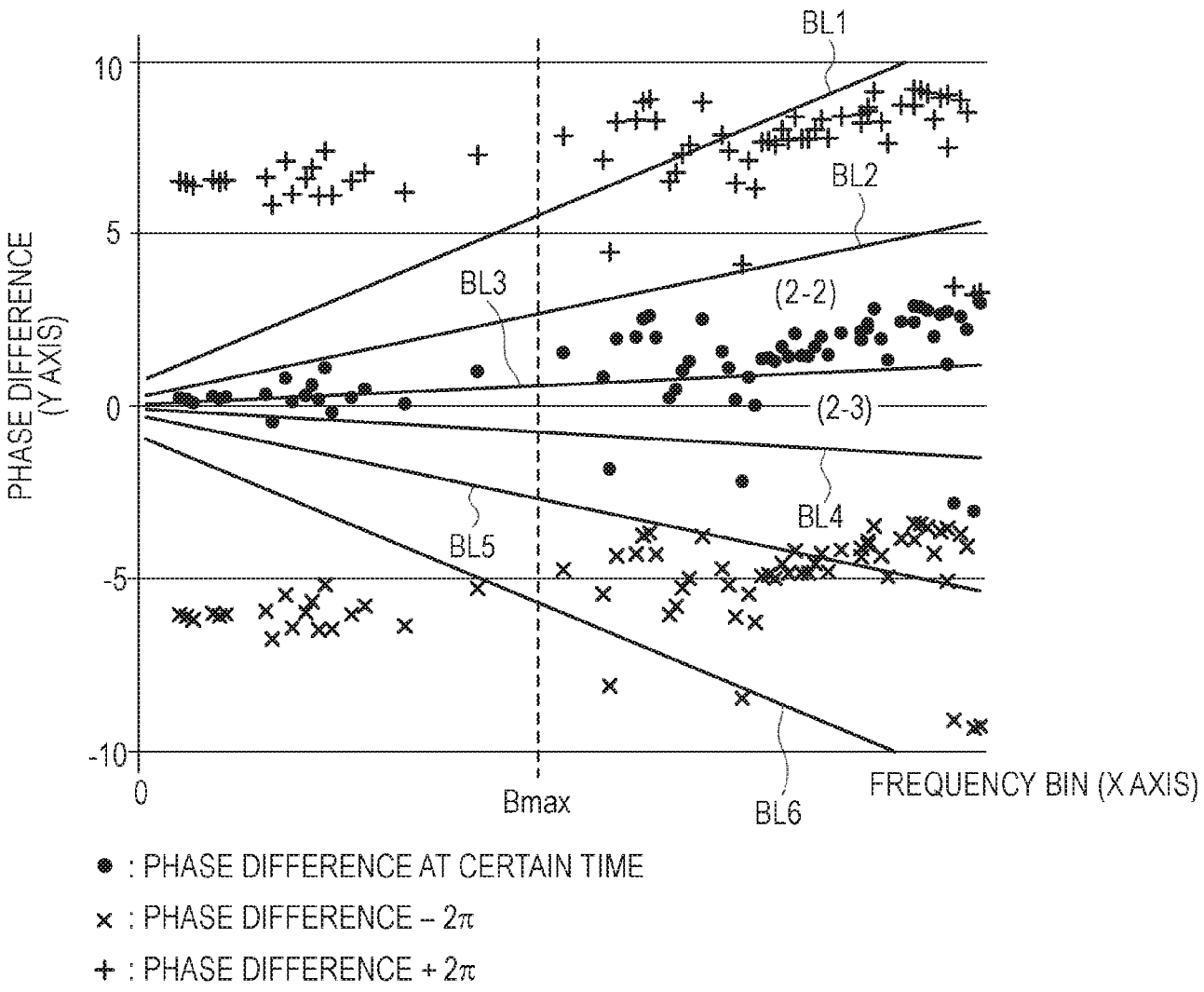
FIG. 19 is a diagram describing a method of identifying a range in which a sound source exists according to the second embodiment.
Figure 20:
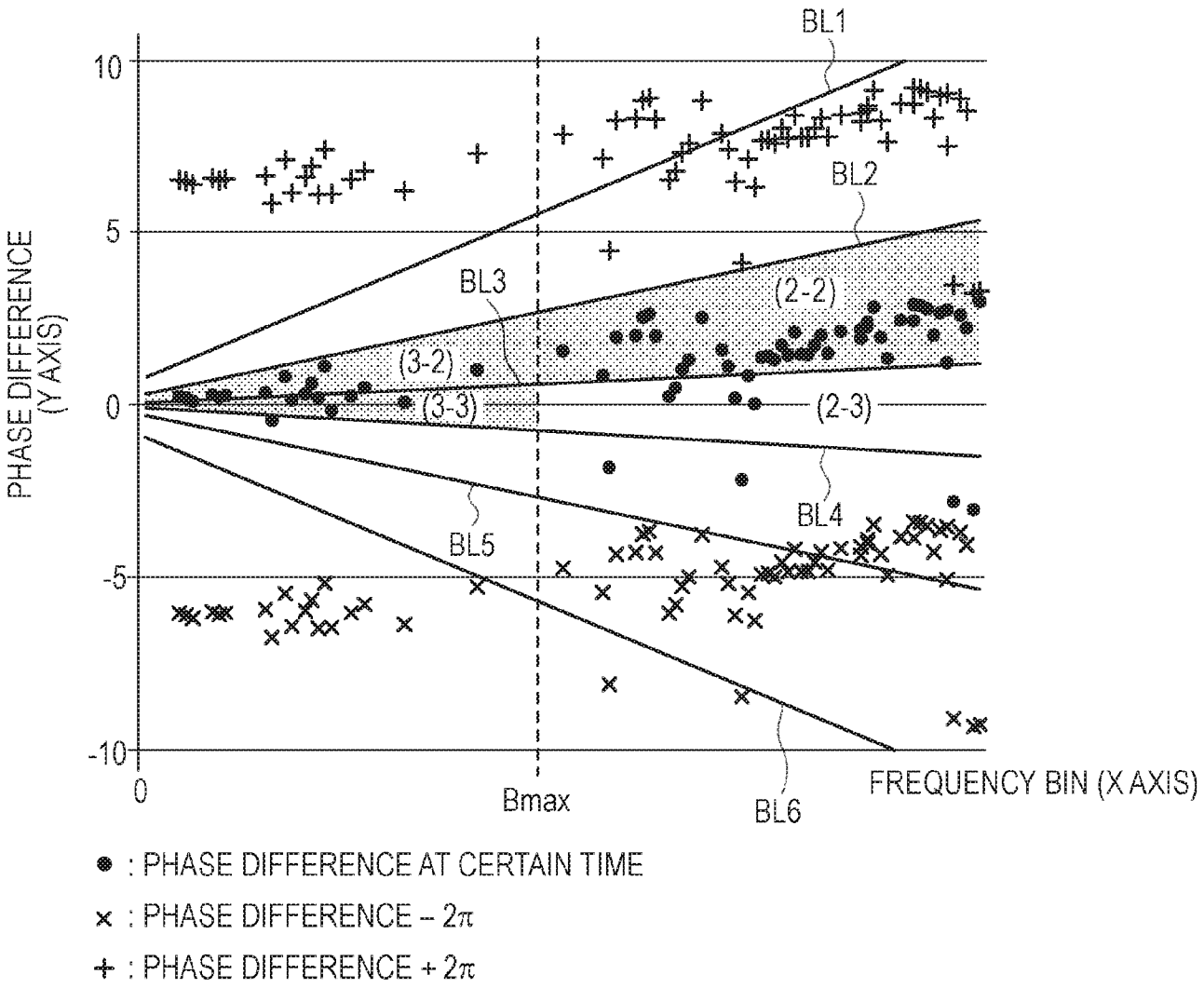
FIG. 20 is a diagram describing the method of identifying a range in which a sound source exists according to the second embodiment.

A method of identifying a phase difference range in which a sound source exists according to the second embodiment is described based on a specific example with reference to FIGS. 19 and 20. FIGS. 19 and 20 are diagrams describing the method of identifying a range in which a sound source exists according to the second embodiment.

The specific example assumes that the range selector 4E selects the phase difference ranges (2-2) and (2-3) and that the first identifying unit 4F1 identifies the phase difference range (2-2) among the phase difference ranges (2-2) and (2-3). In this case, since the phase difference range (2-3) is adjacent to the phase difference range (2-2) as illustrated in FIG. 20, the second identifying unit 4F2 identifies, as a phase difference range in which the sound source exists, a phase difference range (3-3) that is within the phase difference range (2-3) and corresponds to the low-frequency band equal to or lower than the maximum frequency Fmax at which phase rotation does not occur. In this case, the identifying unit 4F identifies, as phase difference ranges in which the sound source exists, the phase difference ranges (2-2) and (3-3), as illustrated in FIG. 20.

According to the second embodiment, the noise suppression device 1 selects phase difference ranges in which a sound source may exist at a high probability and identifies a phase difference range that is among the selected phase difference ranges and in which the sound source exists. When multiple phase difference ranges are selected and at least any of the selected phase difference ranges is a phase difference range that is adjacent to an identified phase difference range, the noise suppression device 1 identifies also, as a phase difference range in which a sound source exists, a phase difference range that is included in the phase difference range adjacent to the identified phase difference range and corresponds to the low-frequency band equal to or lower than the maximum frequency Fmax at which phase rotation does not occur. Thus, phase difference ranges that correspond to the low-frequency band in which the accuracy of phase differences is low may be set to be large, while phase difference ranges that correspond to the middle- or high-frequency band in which the accuracy of phase differences is high may be set to be small. Thus, the accuracy of suppressing noise may be improved.

Figure 21:
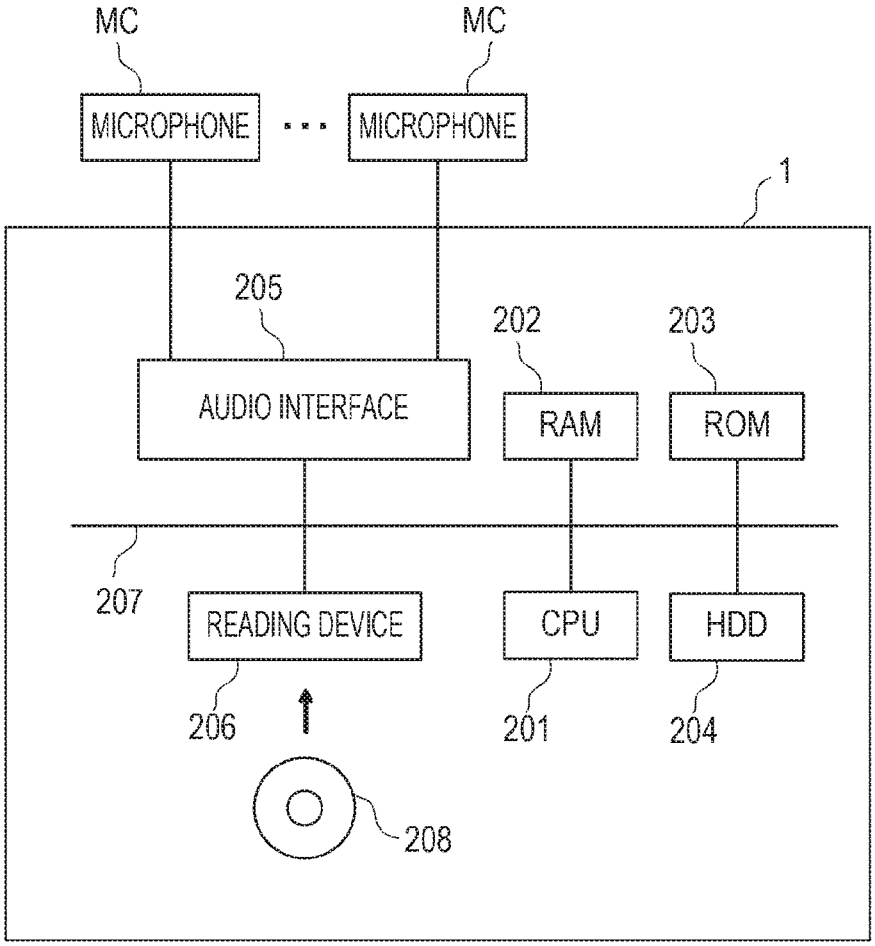
FIG. 21 is a diagram illustrating an example of a hardware configuration of each of the noise suppression devices according to the embodiments.

FIG. 21 is a diagram illustrating an example of a hardware configuration of each of the noise suppression devices 1 according to the embodiments. Each of the noise suppression devices 1 illustrated in FIG. 1 and the like may be achieved by hardware parts illustrated in FIG. 21, for example. In the example illustrated in FIG. 21, the noise suppression devices 1 each have a CPU 201, a RAM 202, a ROM 203, an HDD 204, an audio interface 205 to be connected to the microphones MC and the like, and a reading device 206. The hardware parts are connected to each other through a bus 207.

The CPU 201 loads an operation program stored in the HDD 204 into the RAM 202 and executes the various processes while using the RAM 202 as a working memory. The CPU 201 executes the operation program and thereby achieves the functional units of the controller 40 illustrated in FIG. 1 and the like.

The aforementioned processes may be executed by storing the operation program to be used to execute the aforementioned operations in a computer-readable recording medium 208 such as a flexible disk, a compact disc-read only memory (CD-ROM), a digital versatile disc (DVD), or a magneto-optical disc (MO), distributing the operation program, reading the operation program by the reading device 206 of the noise suppression device 1, and installing the operation program in the computer. The operation program may be stored in a disk device or the like included in a server device on the Internet and be downloaded into the computer of the noise suppression device 1 through a communication module (not illustrated).

In each of the embodiments, a storage device of another type other than the RAM 202, the ROM 203, and the HDD 204 may be used. For example, each of the noise suppression devices 1 may include storage devices such as a content addressable memory (CAM), a static random access memory (SRAM), and a synchronous dynamic RAM (SDRAM).

In the embodiments, the hardware configuration of each of the noise suppression devices 1 may be different from that illustrated in FIG. 21, and hardware other than the standards and types exemplified in FIG. 21 is applicable to the noise suppression devices 1.

For example, the functional units of each of the controllers 40 of the noise suppression devices 1 illustrated in FIG. 1 and the like may be achieved by a hardware circuit. Specifically, the functional units of each of the controllers 40 illustrated in FIG. 1 and the like may be achieved by a configurable circuit such as a field programmable gate array (FPGA), an application specific integrated circuit (ASIC), a digital signal processor (DSP), or the like. The functional units may be achieved by the CPU 201 and the hardware circuit.

The embodiments are described above. It is, however, to be understood that the embodiments are not limited to the aforementioned embodiments and may include various modified and alternative examples of the aforementioned embodiments. For example, it will be understood that the embodiments may be achieved by modifying at least any of the constituent elements without departing from the gist and scope of the embodiments. In addition, it will be understood that various embodiments may be achieved by combining at least two of the constituent elements disclosed in the aforementioned embodiments. Furthermore, it will be understood by persons skilled in the art that various embodiments may be achieved by removing constituent elements from all the constituent elements described in the embodiments, replacing constituent elements among all the constituent elements described in the embodiments with other constituent elements, or adding constituent elements to the constituent elements described in the embodiments.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A noise suppression device configured to suppress noise in signals input from a plurality of microphones, the noise suppression device comprising:

a generator configured to generate, on basis of phase differences between phases of the signals input from the plurality of microphones for each frequency, additional data obtained by rotating the phase differences;

an estimator configured to select, on basis of the phase differences in a frequency band in which the phase differences are not rotated, one or multiple ranges in association with a direction in which a sound source of a target sound included in the input signals exists at a high probability, the one or multiple ranges being defined on a frequency and phase difference plane, and to estimate, on basis of the phase differences and the additional data, a range that is among the selected one or multiple ranges and in which exists the sound source; and an output signal generator configured to generate, on basis of a suppression coefficient set on basis of a result of determination of whether or not the sound source exists in the estimated range, an output signal in which the noise in the input signals is suppressed.

2. The noise suppression device according to claim 1, wherein the estimator selects a range on the frequency and phase difference plane on basis of the number of the phase differences in the frequency band in which the phase differences are not rotated.

3. The noise suppression device according to claim 1, wherein the estimator further estimates the range that is among the selected one or multiple ranges and exists in the direction toward the sound source on basis of the number of the phase differences and additional data within the selected one or multiple ranges in an entire frequency band.

4. The noise suppression device according to claim 1, wherein when an adjacent range that is any of the one or multiple ranges and is adjacent to the estimated range, the estimator estimates, as a range in which the sound source exists, a range in a frequency band in which the phase differences are not rotated, the range being included in the adjacent range.

5. The noise suppression device according to claim 1, further comprising a calculator configured to calculate the suppression coefficient on basis of whether or not the sound is generated from the range in which the sound source exists.

6. The noise suppression device according to claim 5, wherein the calculator determines whether or not any of the phase differences and the additional data is included in the estimated range corresponding to a frequency band excluding the frequency band in which the phase differences are not rotated, and thereby determines whether or not the sound is generated from the range in which the sound source exists.

7. The noise suppression device according to claim 5, wherein the calculator determines whether or not the phase differences are included in the estimated range corresponding to the frequency band in which the phase differences are not rotated, determines whether or not any of the phase differences and the additional data is included in the estimated range corresponding to the frequency band excluding the frequency band in which the phase differences are not rotated, and thereby determines whether or not the sound is generated from the range in which the sound source exists.

8. The noise suppression device according to claim 1, further comprising a setting unit configured to set a plurality of ranges into which a range of the phase differences is divided on the frequency and phase difference plane.

9. The noise suppression device according to claim 8, wherein the setting unit sets a plurality of equal ranges into which the range of the phase differences is divided on the frequency and phase difference plane.

10. The noise suppression device according to claim 8, wherein the setting unit sets a plurality of ranges into which the range of the phase differences is divided on the frequency and phase difference plane and that each become wider as absolute values of phase differences included in the range become larger.

11. The noise suppression device according to claim 8, wherein the setting unit sets the plurality of ranges so as to ensure that a part of each of the ranges overlap a part of at least any of ranges adjacent to the range.

12. The noise suppression device according to claim 8, wherein the setting unit sets the plurality of ranges so as to ensure that the ranges of the phase differences are smaller as the frequency is lower.

13. A noise suppression method to be executed by a noise suppression device configured to suppress noise in signals input from a plurality of microphones, the noise suppression method comprising:

generating, on basis of differences between phases of the signals input from the microphones for frequencies, additional data obtained by rotating the phase differences;

selecting, on basis of the phase differences in a frequency band in which the phase differences are not rotated, one or multiple ranges in association with a direction in which a sound source of a target sound included in the input signals exists at a high probability, the one or multiple ranges being defined on a frequency and phase difference plane;

estimating, on basis of the phase differences and the additional data, a range that is among the selected one or multiple ranges and exists in the direction toward the sound source; and generating, on basis of a suppression coefficient set on basis of a result of determination of whether or not the sound source exists in the estimated range, an output signal in which the noise in the input signals is suppressed.

14. A non-transitory computer-readable recording medium having stored therein a program for causing a computer to execute a process for noise suppression in signals input from a plurality of microphones, the process comprising:

generating, on basis of differences between phases of the signals input from the microphones for frequencies, additional data obtained by rotating the phase differences;

selecting, on basis of the phase differences in a frequency band in which the phase differences are not rotated, one or multiple ranges in association with a direction in which a sound source of a target sound included in the input signals exists at a high probability, the one or multiple ranges being defined on a frequency and phase difference plane;

estimating, on basis of the phase differences and the additional data, a range that is among the selected one or multiple ranges and in which the sound source exists; and generating, on basis of a suppression coefficient set on basis of a result of determination of whether or not the sound source exists in the estimated range, an output signal in which the noise in the input signals is suppressed.

15. The noise suppression device according to claim 1, wherein the one or multiple ranges includes at least one phase difference range in which a number of the phase differences is the largest, and the estimated range is one of a first phase difference range in which a number of phase differences and the additional data is larger than a predetermined threshold in an entire frequency band and a second phase difference range in which the number of phase differences and the additional data is the largest in an entire frequency band.

* * * * *